US009737748B1

(12) United States Patent
Chapman et al.

(10) Patent No.: US 9,737,748 B1
(45) Date of Patent: Aug. 22, 2017

(54) LOW FRICTION REHABILITATION BOARD WITH AN INTEGRAL BAND RETAINING FEATURE

(71) Applicant: P.T. ROM Associates LLC, Elkton, MD (US)

(72) Inventors: Randall F Chapman, Elkton, MD (US); Frank M Chapman, Elkton, MD (US)

(73) Assignee: P.T. ROM And Associates LLC, Elkon, MD (US)

( * ) Notice: Subject to any disclaimer, the term of this patent is extended or adjusted under 35 U.S.C. 154(b) by 48 days.

(21) Appl. No.: 14/929,436

(22) Filed: Nov. 2, 2015

Related U.S. Application Data

(63) Continuation-in-part of application No. 13/602,179, filed on Sep. 2, 2012, now abandoned.

(60) Provisional application No. 61/530,470, filed on Sep. 2, 2011.

(51) Int. Cl.
*A63B 21/055* (2006.01)
*A63B 21/04* (2006.01)
*A63B 21/16* (2006.01)

(52) U.S. Cl.
CPC ..... *A63B 21/0442* (2013.01); *A63B 21/1681* (2013.01)

(58) Field of Classification Search
CPC ..... A63B 22/14; A63B 22/16; A63B 21/0442; A63B 21/0557; A63B 21/1681
USPC ..... 482/142–147, 129
See application file for complete search history.

(56) References Cited

U.S. PATENT DOCUMENTS

| | | | | |
|---|---|---|---|---|
| 3,298,232 | A * | 1/1967 | Carboni | A63B 69/0079 473/143 |
| 5,178,596 | A * | 1/1993 | McIntire | A63B 21/0552 482/122 |
| 5,417,636 | A * | 5/1995 | Havens | A63B 21/0552 482/140 |
| 6,884,504 | B2 * | 4/2005 | Liu | C09J 7/0221 283/81 |
| 2006/0052220 | A1 * | 3/2006 | Jackson | A63B 21/04 482/52 |
| 2012/0115692 | A1 * | 5/2012 | Bussen | A63B 21/0442 482/130 |

* cited by examiner

*Primary Examiner* — Sundhara Ganesan
*Assistant Examiner* — Rae Fischer
(74) *Attorney, Agent, or Firm* — Invention To Patent Services; Alex Hobson

(57) ABSTRACT

A low friction rehabilitation board having an integral band retaining feature is described. The rehabilitation board may have a coefficient of static friction of no more than about 0.5 and in some embodiments no more than about 0.06. A non-slip material may be attached to the bottom surface of the rehabilitation board. A band retaining feature is described as being integral to the rehabilitation board such that it is attached to the board, or may be fastened to the board. Additionally, in some embodiments, the board comprises range markings for the determination of the degree or amount of exertion or extension. Furthermore, the range markings may be calibrated to specific resistance band types. In other embodiments, the rehabilitation board may be configured with interlocking features to provide a modular option for combining boards when more extension is required.

17 Claims, 28 Drawing Sheets

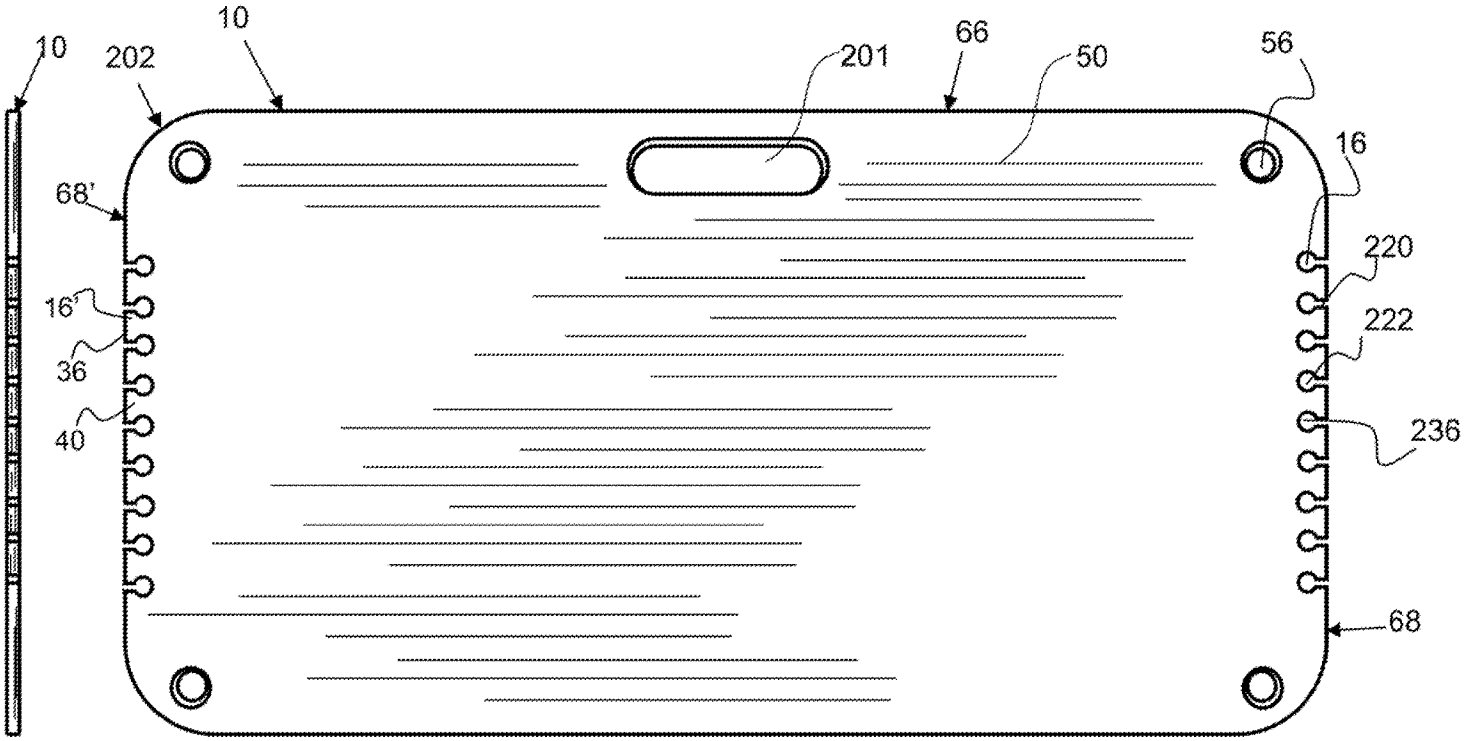
FIG. 19
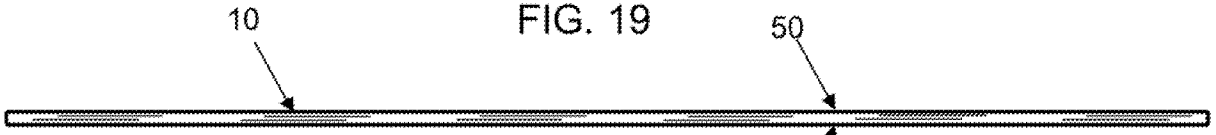
FIG. 20
FIG. 21

LOW FRICTION REHABILITATION BOARD WITH AN INTEGRAL BAND RETAINING FEATURE

CROSS REFERENCE TO RELATED APPLICATIONS

The current application is a continuation in part application of U.S. patent application Ser. No. 13/602,179, filed on Sep. 2, 2012, entitled Low Friction Rehabilitation Board With an Integral Band Retaining Feature and, which claims the benefit of provisional patent No. U.S. 61/530,470, filed on Sep. 2, 2011 and entitled Low Friction Rehabilitation Board With an Integral Band Retaining Feature; the entirety of both applications are incorporated by reference herein.

BACKGROUND OF THE INVENTION

Field of the Invention

The invention relates to rehabilitation boards and in particular, low friction rehabilitation boards having an integral band retaining feature.

Background

Rehabilitation boards and/or bands are used in a wide variety of applications, such as the rehabilitation and/or strengthening of upper and lower body limbs. The boards and bands may be used for physical therapy, injury prevention, and athletic training or conditioning. In some applications, the boards and bands are used to strengthen, and in other applications, to extend the range of motion of limbs.

Rehabilitation boards are often made of a rigid board and some have non-slip materials attached to the bottom surface to prevent the board from moving during use. Rehabilitation boards may be made of any suitable material such as wood or a polymer material, however many of these polymer materials have a higher coefficient of friction than desired. When the coefficient of friction of the rehabilitation board is too high, the patient or user may have to exert additional force just to overcome the frictional forces of the board. In addition, repetitive motion across a rehabilitation board having a high coefficient of friction may result in skin abrasion.

Rehabilitation bands are used to provide varying levels of resistance during exercises. A user may be instructed to place a limb through a band, or grasp a band and extend it a certain amount and return. The user may be instructed to repeat this motion for a certain number of repetitions. As the user or patient strengthens their muscles, the user may be instructed to use a higher resistance band. In some cases, the bands are provided in different colors, wherein each color band has a specific resistance response. The resistance of many of these color-coded bands are predetermined such that extension to a certain degree requires a predetermined force.

In most cases, the user may be instructed to extend a band a certain amount, however there is typically no indication of how far to extend the band. As a result, there is no way of determining or monitoring exactly how far a user extends the band. Furthermore, there is no way of determining the force the user is exerting to extend the band.

Resistance bands are sometimes attached to a fixed object by being looped around or tied to the fixed object, and a user typically inserts a limb into the loop or grasps the band. It is often inconvenient to find a proper fixed object for the attachment of the band. The fixed object may not be secure enough and present a dangerous situation. In addition, it may be difficult to position the rehabilitation board in close enough proximity to the fixed object, therein making it more difficult for the user to complete their exercises.

There exists a need for a rehabilitation board that has a means to attach a rehabilitation band, and a way to determine the specific amount of force a user is exerting during the rehabilitation exercises.

SUMMARY OF THE INVENTION

The invention is directed to a rehabilitation board having a low friction material on the top, or working surface, and at least one band retaining feature. In another embodiment, the rehabilitation board comprises a non-slip material on at least a portion of the bottom surface and range markings. The rehabilitation board described herein comprises a low static coefficient of friction material on the working surface. The static coefficient of friction may be no more than about 0.05, such as 0.04, or no more than about 0.50. A low static coefficient of friction allows a user to easily move a limb across the board with minimal resistance. The low friction rehabilitation boards described herein may also reduce or eliminate chaffing or abrasion the user may experience after repetitive motion across higher coefficient of friction boards.

A rehabilitation board, as described herein, may comprise any suitable type of material including, but not limited to, wood, wood composite materials, polymers, plastics, rubber, elastomers, metal, foams and the like. The working surface of the rehabilitation board comprises a low coefficient of friction material that may include, but is not limited to, high density polyethylene (HDPE), ultrahigh molecular weight polyethylene (UHMWPE), or fluoropolymers, such as polytetrafluoroethylene (PTFE). The static coefficient of friction of HDPE, as tested against itself according to ASTM 1894, may be as low as 0.095 and the kinetic coefficient of friction may be 0.097. UHMWPE has a static coefficient of friction of approximately 0.17 and PTFE has an ultralow static coefficient of friction of approximately 0.04 according to ASTM 1894 when tested against itself. ASTM 1894 is hereby incorporated by reference herein. In some embodiments, the static coefficient of friction of the top surface of the rehabilitation board is no more than about 0.09, no more than about 0.06, no more than about 0.04, no more than about 0.15, no more than about 0.20, or no more than about 0.25 according to ASTM 1894 when tested against itself, or the same material. The dynamic coefficients of friction of UHMWPE and PTFE are approximately 0.15 and 0.1 respectively. In one embodiment, the static coefficient of friction is less than the dynamic coefficient of friction which eliminates stick slip motion.

In some embodiments, the rehabilitation board described herein may comprise a composite, laminate, or layered materials, where the working surface comprises a low friction material, such as a thin layer of low friction material laminated or otherwise attached or fastened to another material. The thin layer of low friction material may be any suitable thickness such as no more than about 15 mm, no more than about 10 mm, or no more than about 5 mm thick. In some embodiments, the low friction material is "thin." as used herein, and is no more than about 2.5 mm thick. In yet other embodiments, the low friction material is "ultrathin," as used herein, and is no more than about 0.010 mm thick or in some cases no more than about 0.005 mm thick. Low friction material may be expensive and utilizing a thinner layer attached to a thicker board material may provide economic benefits while providing a very low friction working surface. The low friction material may cover substantially all of the working surface or only a portion of the working surface. A low friction material may be sprayed onto and adhered to the board.

A person may also use a complimentary material between their skin and the rehabilitation board described herein to further facilitate low friction motion. For example, a person may slip a sock or bootie over their foot or shoe prior to moving their foot across the rehabilitation board. In addition, a person may simply place any suitable type of material between their skin and the board. For example, a person may place a complimentary material under their elbow prior to placing their elbow on the rehabilitation board. A complimentary material may be a fabric, such as a non-woven material, foam, a polymeric or plastic material, combinations of materials, and the like.

The rehabilitation board described herein may further comprise range markings that allow the user or instructor to define a set motion goal including movement of a limb or extension of a resistance band to a specific marking. Furthermore, the range markings may comprise percentage indicator markings to provide the user with some indication of degree of motion across the board. The range markings may be force indication markings that are calibrated with specific resistance band types. For example, red range markings having force levels across the board, may be calibrated to a red resistance band, such that the user and instructor know how much force the user is exerting to extend the red band to a preset range marking. The rehabilitation board may have multiple range markings which may be color calibrated with resistance bands of specific colors. The range markings may be printed directly onto the rehabilitation board or they may detachably attachable to the rehabilitation board. In one embodiment, the range markings are configured on a thin sheet of material that may be slid into a groove configured in the rehabilitation board. Markings of any type, including range markings, may be incorporated onto the rehabilitation board in any suitable manner including, but not limited to, printed, embossed, engraved, attached as stickers, laminated and the like.

The rehabilitation board described herein comprises at least one band retaining feature, and in some embodiments comprises two, three, four, five, six or more band retaining features. The band retaining feature may comprise a post that may be fastened or attached to the rehabilitation board. In one embodiment, a post is attached to the rehabilitation board, and can be rotated to various positions and secured in place. In yet another embodiment, the attached post may be rotated such that at least a portion of the post is recessed into the rehabilitation board. In another embodiment, a fastened post may be stored on or in the board, such as by pushing it into a recess configured to accept and retain the post.

The band retaining feature may comprise an opening that extends at least partially through the rehabilitation board. In one embodiment, the band retaining feature comprises an opening that extends completely through the rehabilitation board wherein a resistance band may be tied to or looped through the opening. In yet another embodiment, a post may be at least partially inserted into an opening and fastened or retained therein. An opening may have a consistent cross-sectional area through the board. For example, an opening may have a uniform circular shape through the thickness of the rehabilitation board. In another embodiment, an opening may have a non-uniform cross-section through the thickness of the board. In one embodiment, an opening may have a smaller cross-sectional area at the working surface than on the opposing surface or bottom surface. A tapered or conical shaped opening may be configured to receive a resistance band having a conical or otherwise tapered plug. A resistance band may be extended through the tapered opening from the bottom surface up to the working surface and the tapered plug inserted into the tapered opening. The conical or tapered opening may be a discrete hole through the rehabilitation board or may be coupled with a slot that extends out to the outer perimeter of the board, such as one of the sides of the board. The tapered plug may have a planar band surface that is flush with the working surface when inserted into the tapered or conical shaped opening. An opening may comprise threads, and a post may comprise matching threads, whereby a post can be threaded into and secured in the opening. In still another embodiment, openings in the board may be configured to act as a handle for transporting the rehabilitation board described herein. One or more openings may be configured near an end or side of the board, such that a person could insert two or more fingers and easily carry the board.

A post may be used to fill an opening when it is not being used, so that the working surface of the rehabilitation board is substantially continuously planar. A post may plug an opening by being inserted into the opening until the top surface of the post is flush with the working surface of the rehabilitation board. In one embodiment, a post comprises a band retaining feature that allows the band to extend from the post when it is inserted flush with the working surface. A post may be configured with a band retaining feature that allows the top surface of the post to be flush with the working surface of the rehabilitation board while retaining one end of a resistance band around a bar configured over a recess in the top of the post.

The band retaining feature may comprise at least one nodule configured into or onto the rehabilitation board, such that a resistance band may be tied to and/or looped around the nodule. The nodule may be a protrusion extending from the rehabilitation board or configured from a cut-away or an otherwise formed recess in the rehabilitation board. A nodule may have an enlarged end and may extend directly out from a side of the rehabilitation board and be in-plane with the rehabilitation board. A nodule may be substantially the same thickness as the rehabilitation board.

A band retaining feature may be located in any suitable location on the rehabilitation board, such as on the working surface, side surfaces, on one or more sides or ends, or within the center portion of the board. Band retaining features may be located on opposing sides of the rehabilitation board. In one embodiment, at least one band retainer is located on each end of the rehabilitation board. In another embodiment, at least one band retainer feature is located on the top surface of the rehabilitation board in close proximity to each end.

The rehabilitation board described herein may further comprise interlocking features, whereby two or more rehabilitation boards may be fastened together. Fastening two or more rehabilitation boards together allows for quickly varying the rehabilitation working surface area. A patient may eventually extend a band further than the length of a single board and may require more rehabilitation working surface area. In addition, some rehabilitation exercises may require a single rehabilitation board while others may require a plurality of rehabilitation boards. An interlocking feature, as described herein, provides a means to detachably attach or temporarily fasten a first rehabilitation board to a second rehabilitation board in a side-by-side manner. An interlocking feature may comprise a geometry along one or more sides of a rehabilitation board that has recesses and protrusions, or more simply stated, a puzzle piece geometry. The puzzle piece geometry may be repetitive, thereby allowing the fastening of one board to another in any desired position along the side having the repetitive puzzle piece geometry. In another embodiment, an interlocking feature is a dove-tail type interlocking feature that comprises a dove-tail recess into a side of a first rehabilitation board, and a complimentary dove-tail extending from at least one side of a second rehabilitation board. A dove-tail interlocking feature, as defined herein, comprises any shaped dove-tail having an enlarged extended portion and a narrower or smaller attached portion, such as the wedge shaped dove-tail, or a "T" shape, or any other suitable shape. In one embodiment, a dove-tail has a partial circular shape, where a smaller cross-section of the circle is attached to a side of a rehabilitation board. For example, a first rehabilitation board may comprise a "T" shaped dove-tail recess extending into one or more sides. A second rehabilitation board may comprise a complimentary "r" shaped protrusion, or dove-tail extending from one or more sides. The second board may be aligned with the first board, such that the "T" shaped dove-tail fits into the "T" shaped dove-tail recess. The two boards may be fastened together by dove-tail interlocking feature and slid along each other any suitable length. A dove-tail may extend any suitable length of the rehabilitation board. In one embodiment, a plurality of discrete dove-tails extend from a side of a rehabilitation board. In another embodiment, a dove-tail extends substantially the entire length of the a rehabilitation board side. A rehabilitation board may comprise any combination of interlocking features on the four sides of the board. For example, a rehabilitation board may comprise puzzle piece type interlocking features on two opposing sides of the rehabilitation board, and dove-tail type interlocking features on the two remaining sides, with one side having a dove-tail and the other a dove-tail recess. In one embodiment, an interlocking feature may act as, or also be, a band retaining feature. For example, a discrete dove-tail or a dove-tail type interlocking feature may be used to secure a band. Likewise, a puzzle protrusion of a puzzle piece type interlocking feature may be used as a band retaining feature.

The rehabilitation board described herein may comprise a non-slip material on the bottom surface. A non-slip material may be a component of the board or may be fastened or attached to the rehabilitation board. A non-slip material may be an integral component of the board wherein it is not readily detachable from the board and may be adhered or otherwise fastened. In one embodiment, a non-slip surface may comprise a sprayed on material to the board. The non-slip material may cover the bottom surface of the low friction board, or at least a portion of the bottom surface of the low friction board, such as one or more strips attached to the bottom surface. The non-slip material may be attached to the rehabilitation board through the use of any conventional means including, but not limited to, adhesives, fasteners and the like. In one embodiment, a non-slip material is attached to another material, such as a board, that may have a low coefficient of friction material on the working surface. The non-slip material may comprise any suitable material, including but not limited to, pressure sensitive adhesives, silicones, urethanes, rubbers, and the like. The non-slip material may comprise Dycem non-slip material available from Dycem Limited, Warwick, R.I. This material is well known to provide superior non-slip properties on a wide variety of surfaces.

In an exemplary embodiment, a low friction and/or a non-slip layer may be detachably attached to the rehabilitation board. A low friction or a non-slip layer may comprise a pressure sensitive adhesive allowing the layer to be attached over a board surface. In this way, the low friction and/or non-slip layer may be replaced if they become worn. In addition, a low friction and/or a non-slip layer may comprise apertures or cut-outs that are configured to align with a post hole and/or a band retaining feature. A low friction and/or a non-slip layer may only cover a portion of the board. For example, a low friction layer may be configured to cover the central portion of the board where a user may slide their foot thereover.

The rehabilitation board may further comprise a securing feature for better securing the board in a location. In one embodiment, the securing feature comprises a peg that may have one end at least partially inserted into an opening in the board, and a second end that may be inserted into another opening configured in a permanent fixture. In yet another embodiment, the securing feature comprises a peg or wedge that may be fastened to the board and forced against or around a permanent fixture.

The rehabilitation board, as described herein, may be used for any number of different rehabilitation exercises including but not limited to: appendage extension, such as a knee, or elbow extension, hip active assisted Range of Motion (ROM) in supine, heel slides (knee flexion & extension); hip abduction/adduction; shoulder activities seated for ROM; table slides for shoulder flexion/scaption/abduction; horizontal abduction/adduction; internal/external shoulder rotation; hip strengthening activities in supine position; therapy band hip & knee flexion and extension; therapy band hip abduction/adduction; therapy band mini squats (standing on rehabilitation board and holding bands with both hands for resistance); shoulder strengthening exercises standing and in a seated position; seated internal/external rotation with a resistance band in 90/90 position; seated horizontal abduction/adduction; biceps curl in standing or seated position with resistance bands attached to the rehabilitation board, patient may also stand directly on the rehabilitation; shoulder flexion/scaption/abduction and triceps extension with resistance band; standing D1/D2 shoulder flexion/extension; and leg scissor with one leg under the rehabilitation board elevated by post in the peg openings, as shown in FIG. 32. The rehabilitation board of the present invention may allow post-operative exercises because of the low friction working surface, including, but not limited to heel slides, knee flexion and extension, hip abduction/adduction, and shoulder flexion/scaption/abduction. The rehabilitation board, as described herein, having resistance band attached thereto, enables new rehabilitation exercises that were before not possible with conventional rehabilitation equipment, such as resistance band (theraband) assisted passive range of motion hip external rotation with resisted hip abduction in hook lying and non-weight bearing eccentric quad sets with resisted terminal knee extension.

The rehabilitation board of the present invention enables rehabilitation directly after surgery through to resistance load rehabilitation. A patient with a knee operation for example may use the rehabilitation after surgery to slide their foot over the board to extend their knee. As the range of motion improves a patient may then incorporate a resistance band to further rehabilitate the muscles and the joint. A single rehabilitation board may be used, or a plurality of rehabilitation boards may be coupled together, as described herein to provide a larger surface.

The summary is provided as a general introduction to some of the embodiments of the invention and is not to be considered limiting. Additional embodiments, and combinations of the various features are more fully described herein.

BRIEF DESCRIPTION OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
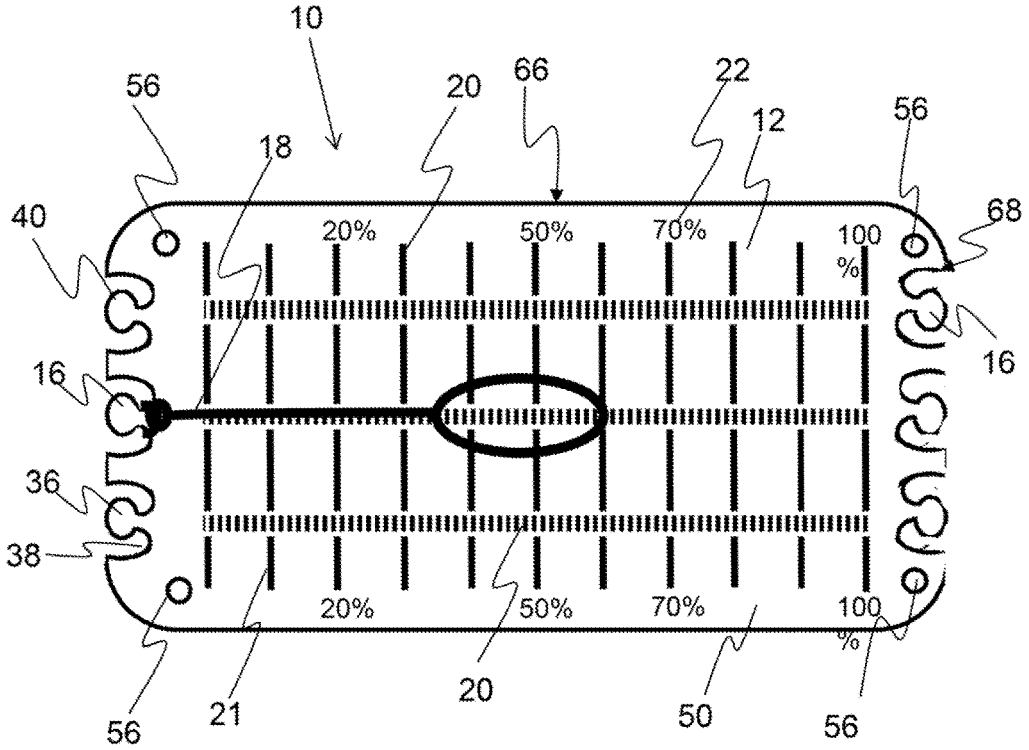

FIG. 1 shows a top view of an exemplary rehabilitation board having nodule type band retaining features on two opposing sides.

Figure 2A:
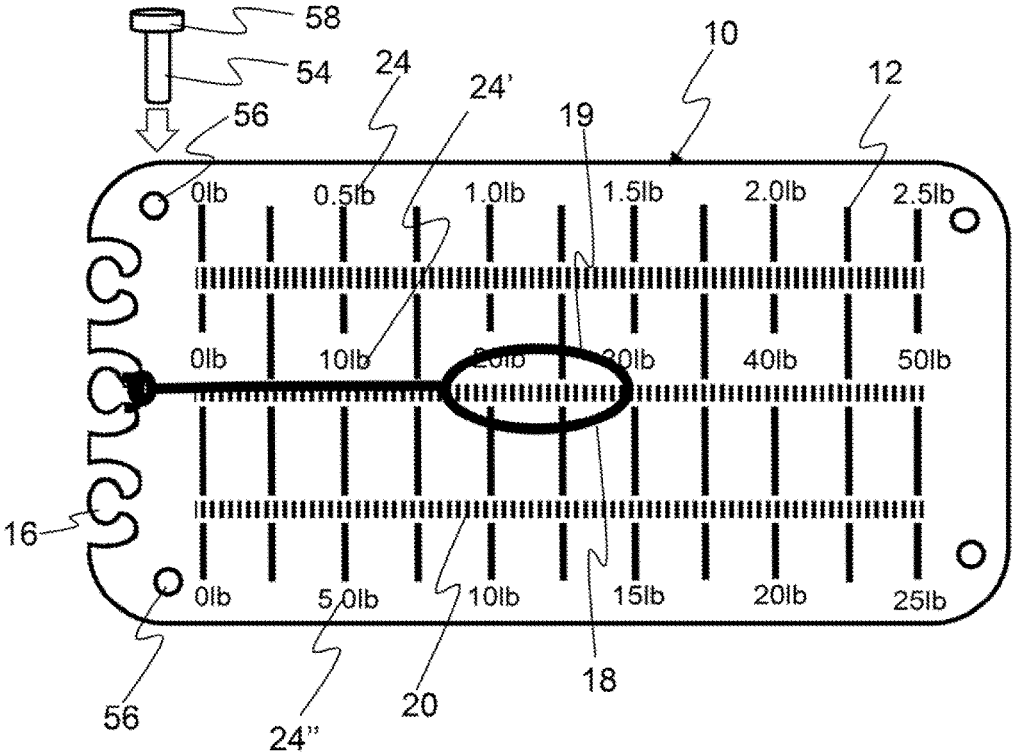

FIG. 2A shows a top view of an exemplary rehabilitation board having force range markings and a securing feature.

Figure 2B:
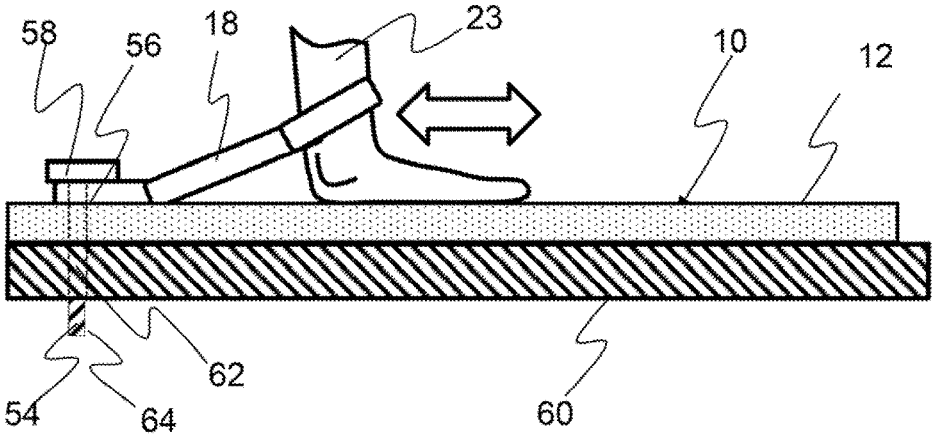

FIG. 2B shows a side view of an exemplary rehabilitation board having a securing feature.

Figure 3A:
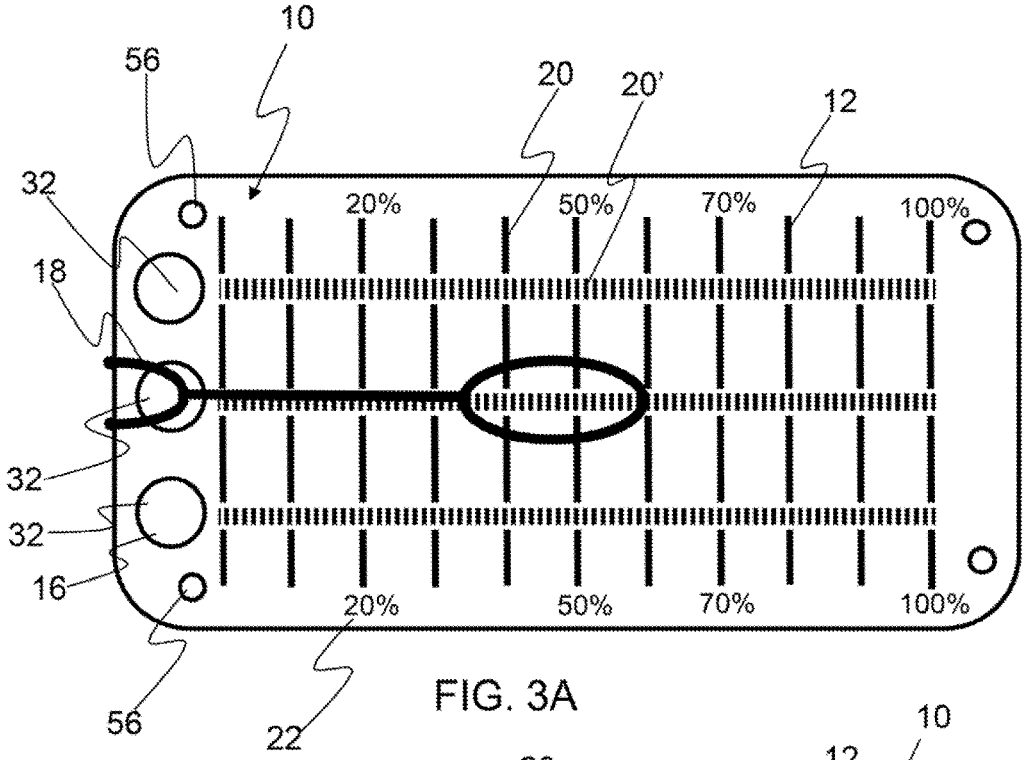

FIG. 3A shows a top view of an exemplary rehabilitation board having opening type band retaining features and percentage range markings.

Figure 3B:
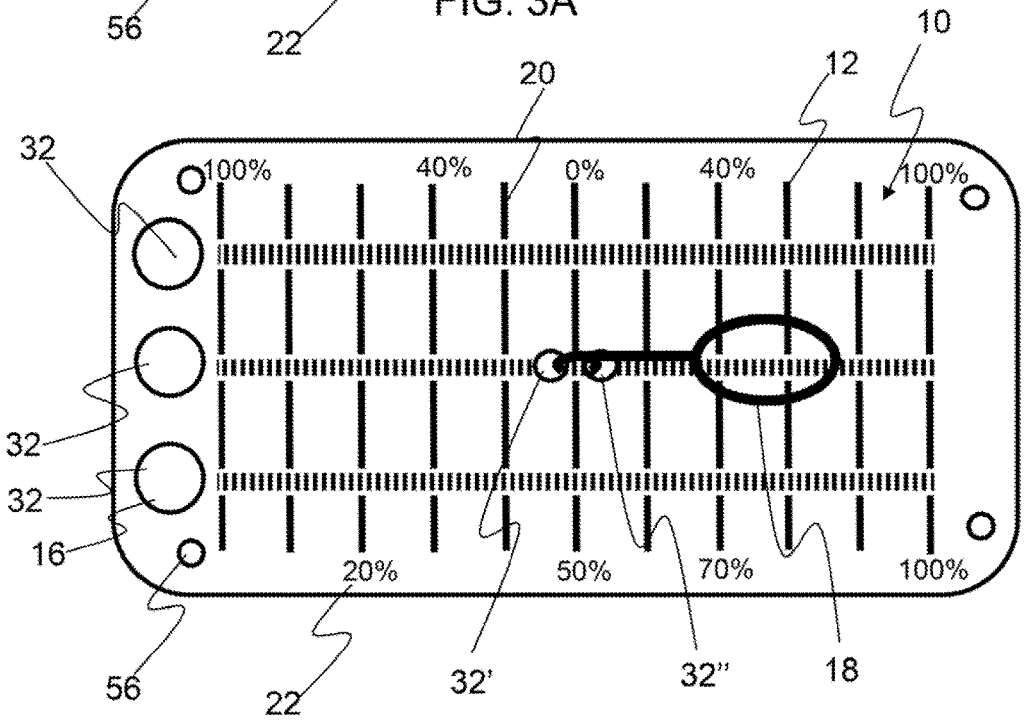

FIG. 3B shows a top view of an exemplary rehabilitation board having a central opening type band retaining feature and percentage range markings extending from the center of the board.

Figure 4A:
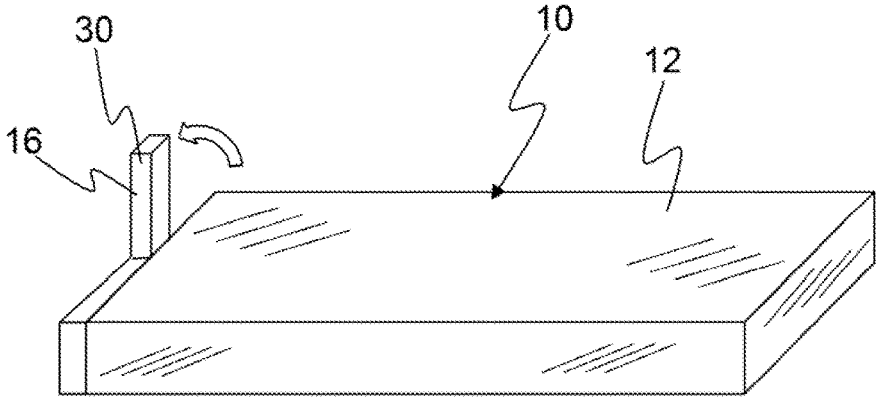

FIG. 4A shows an isometric view of an exemplary rehabilitation board having a post type band retaining feature.

Figure 4B:
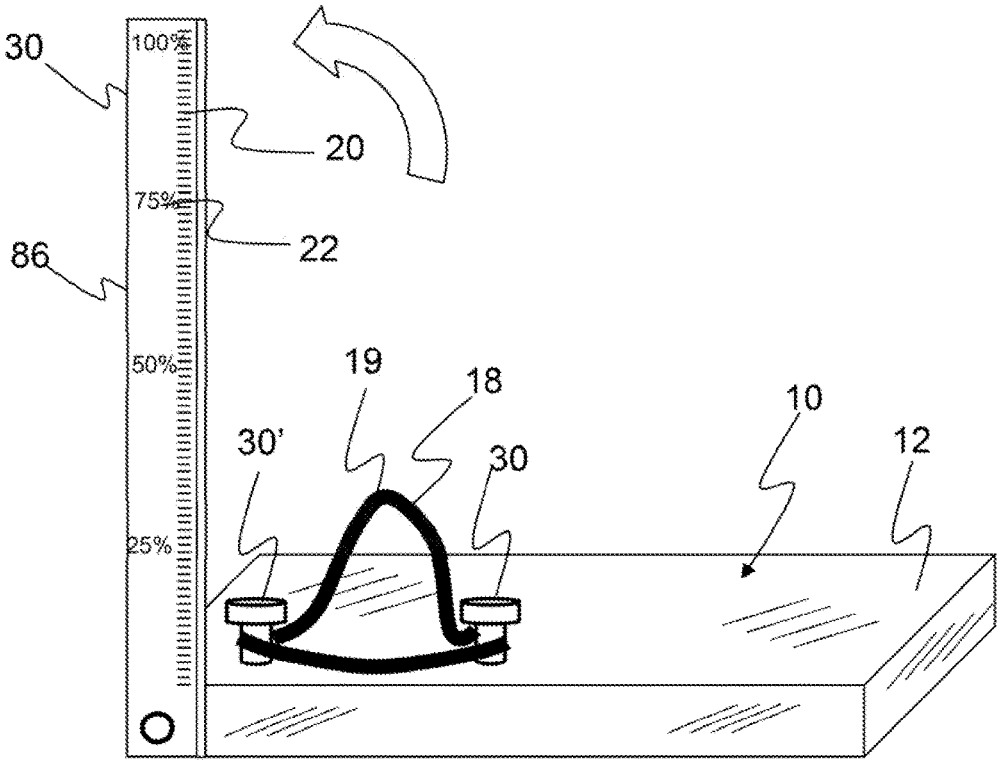

FIG. 4B shows an isometric view of an exemplary rehabilitation board having two post type band retaining features and vertical range of motion indicator markings.

Figure 5A:
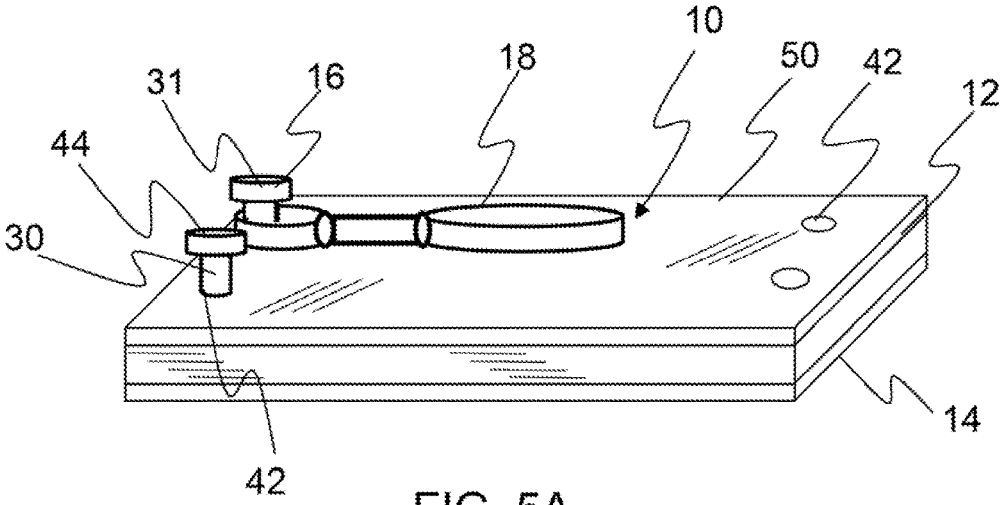

FIG. 5A shows an isometric view of an exemplary rehabilitation board having a two post type band retaining features.

Figure 5B:
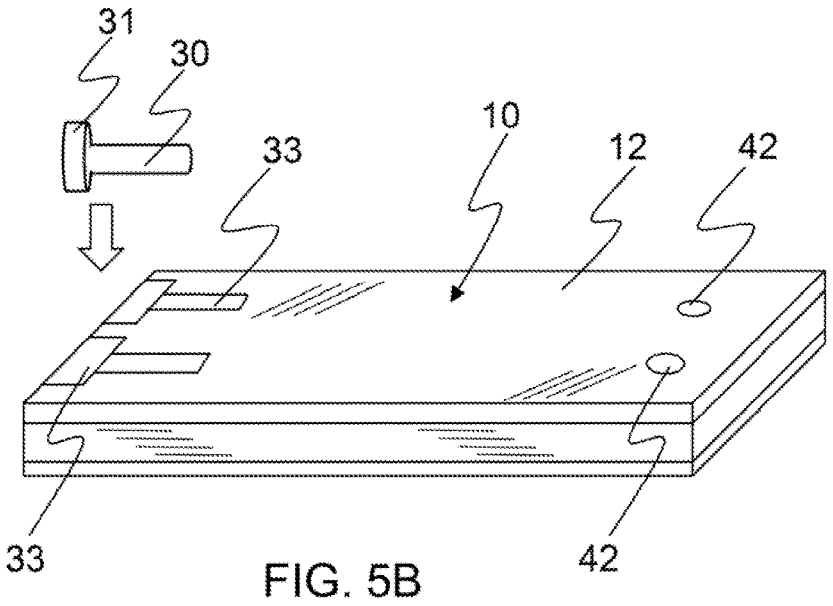

FIG. 5B shows an isometric view of an exemplary rehabilitation board having post type band retaining features and recesses for storing the posts.

Figure 6:
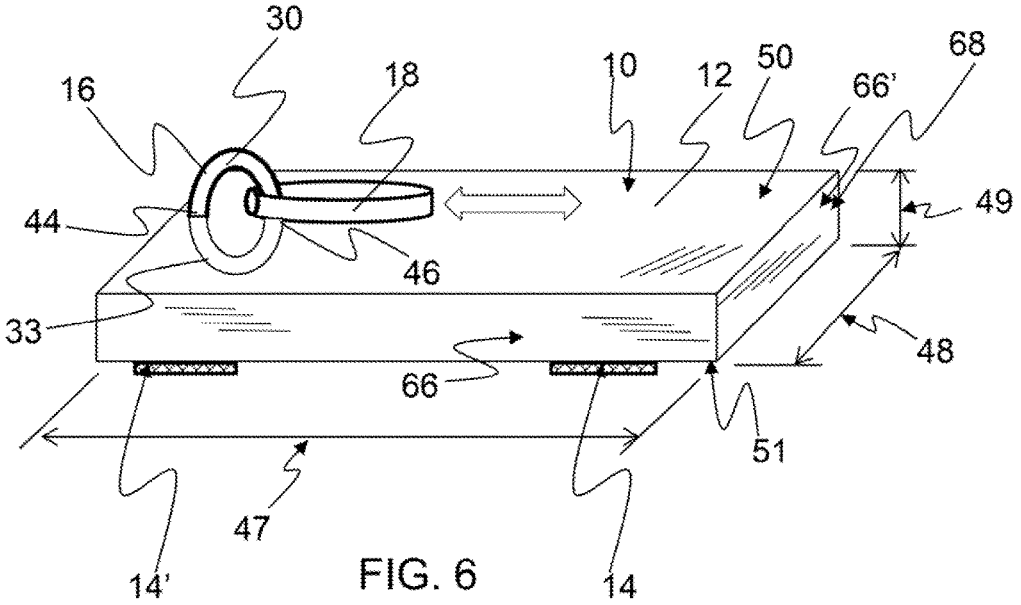

FIG. 6 shows an isometric view of an exemplary rehabilitation board having a post type band retaining feature.

Figure 7A:
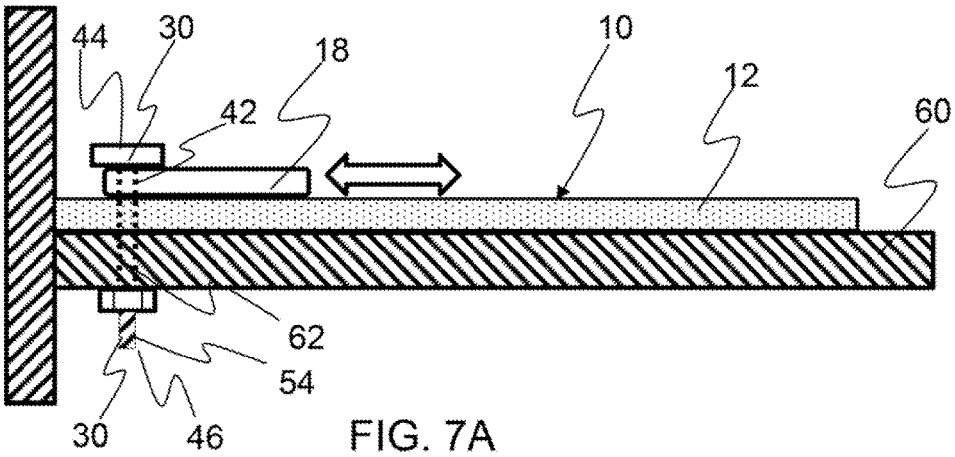

FIG. 7A shows a side view of an exemplary rehabilitation board having a peg extending through the rehabilitation board.

Figure 7B:
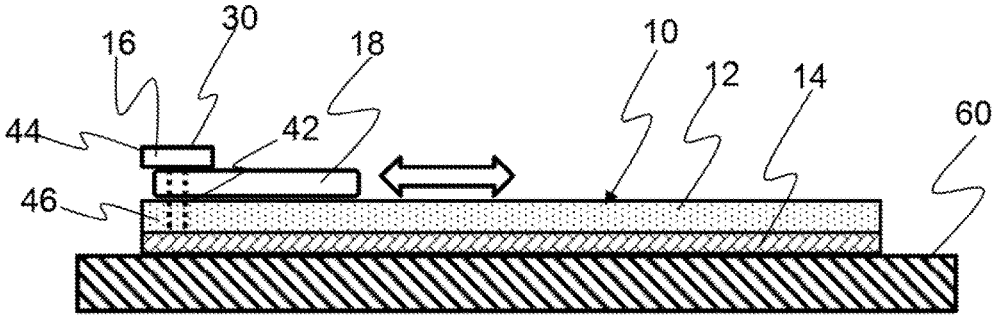

FIG. 7B shows a side view of an exemplary rehabilitation board having a post type band retaining feature.

Figure 8A:
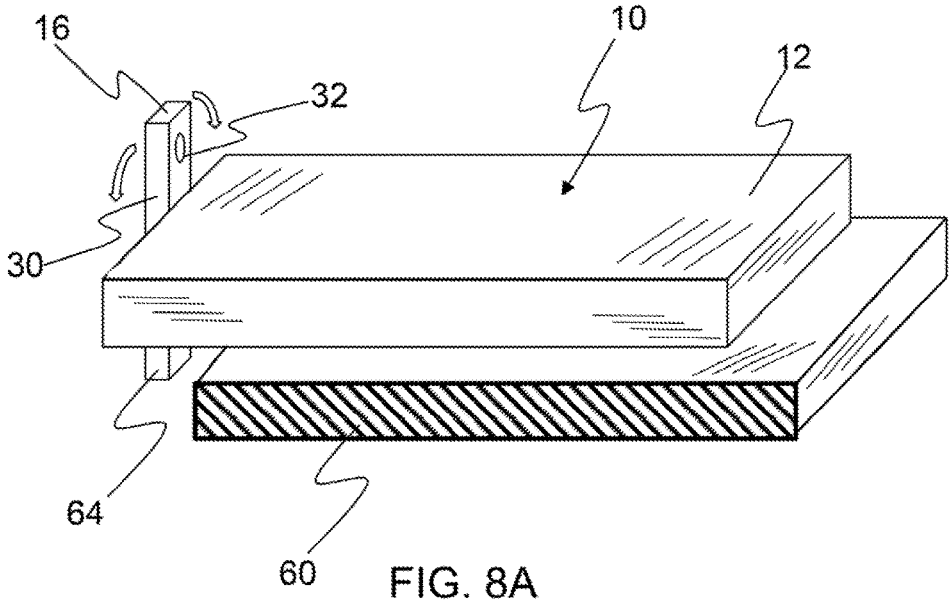

FIG. 8A shows an isometric view of an exemplary rehabilitation board having a post type band retaining feature.

Figure 8B:
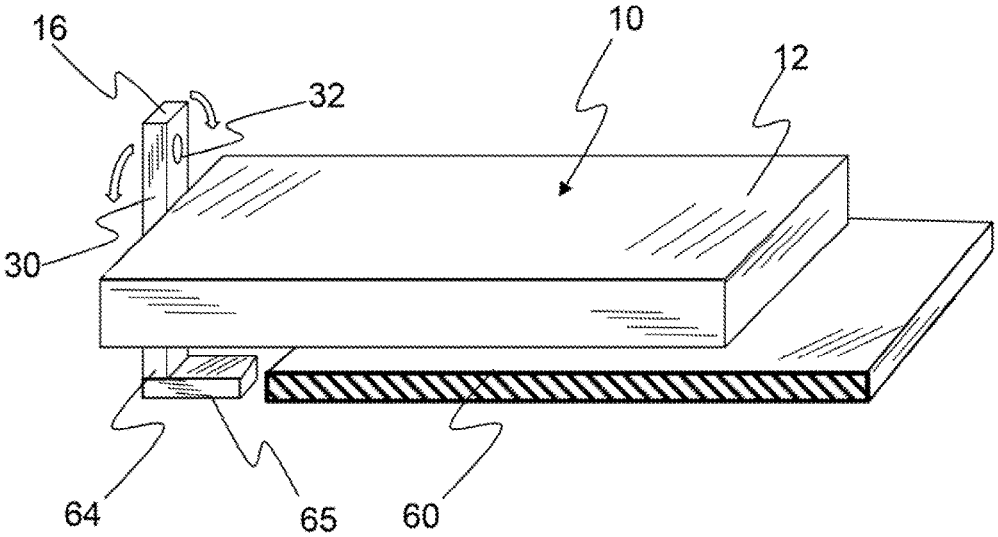

FIG. 8B shows an isometric view of an exemplary rehabilitation board having a post type band retaining feature and a securing feature.

Figure 9A:
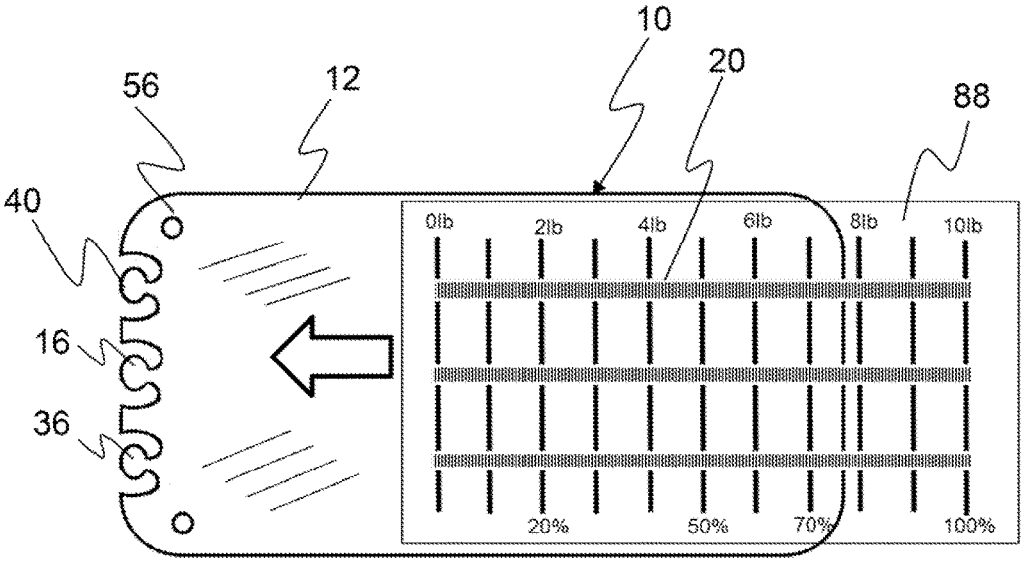

FIG. 9A shows a top view of an exemplary rehabilitation board having a detachable scale with range markings.

FIG. 98 shows a cross-sectional view of an exemplary rehabilitation board having a detachable scale with range markings.

Figure 10A:
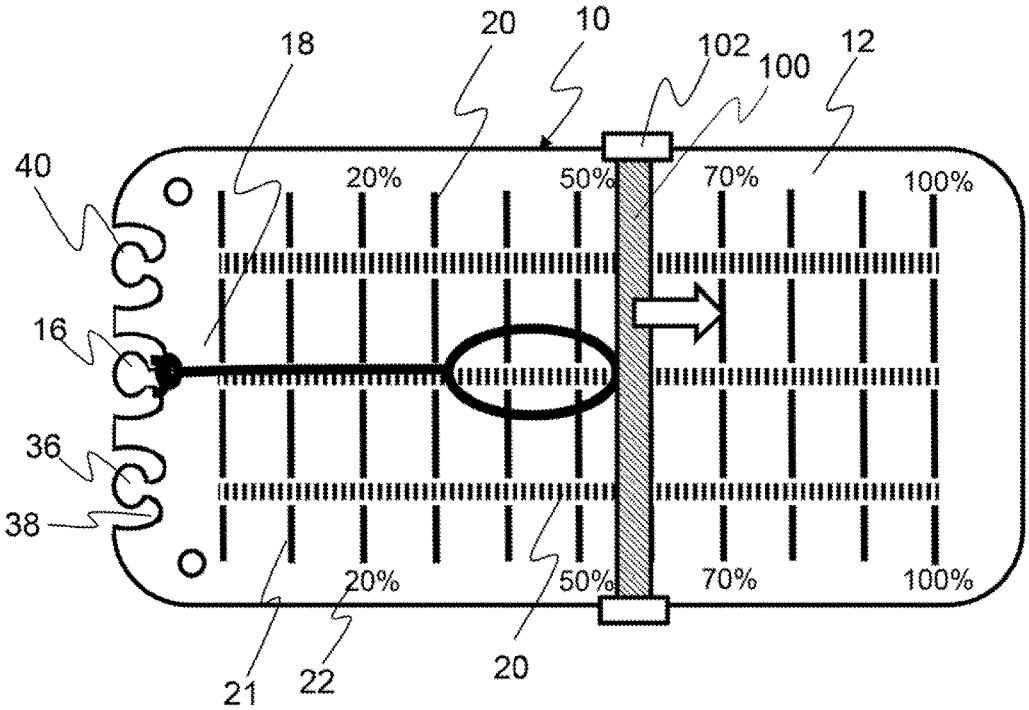

FIG. 10A shows a top view of an exemplary rehabilitation board having an extension indicator.

Figure 10B:
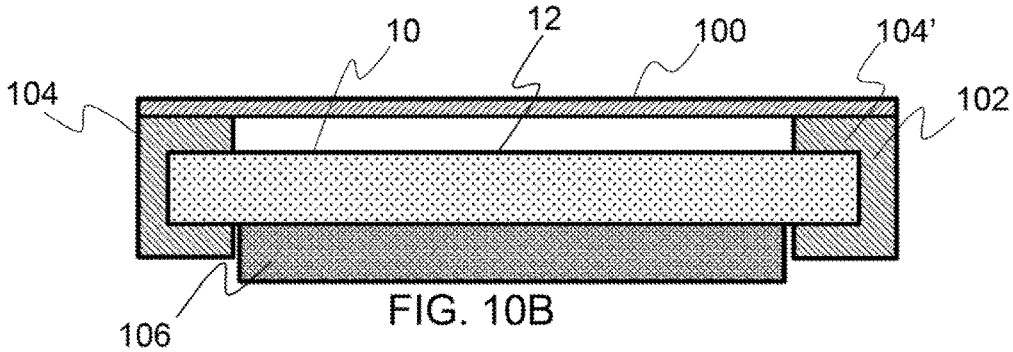

FIG. 10B shows an end view of an exemplary rehabilitation board having an extension indicator.

Figure 10C:
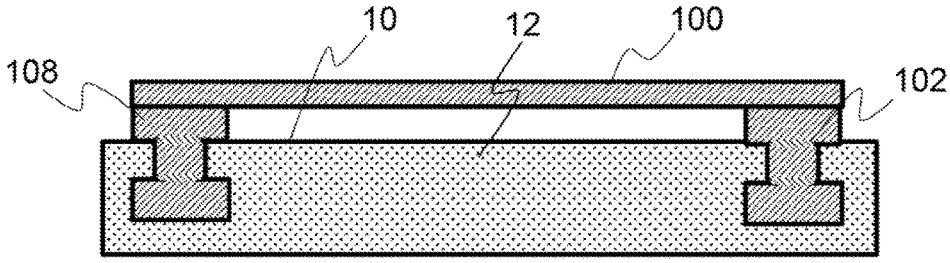

FIG. 10C shows an end view of an exemplary rehabilitation board having an extension indicator.

Figure 11:
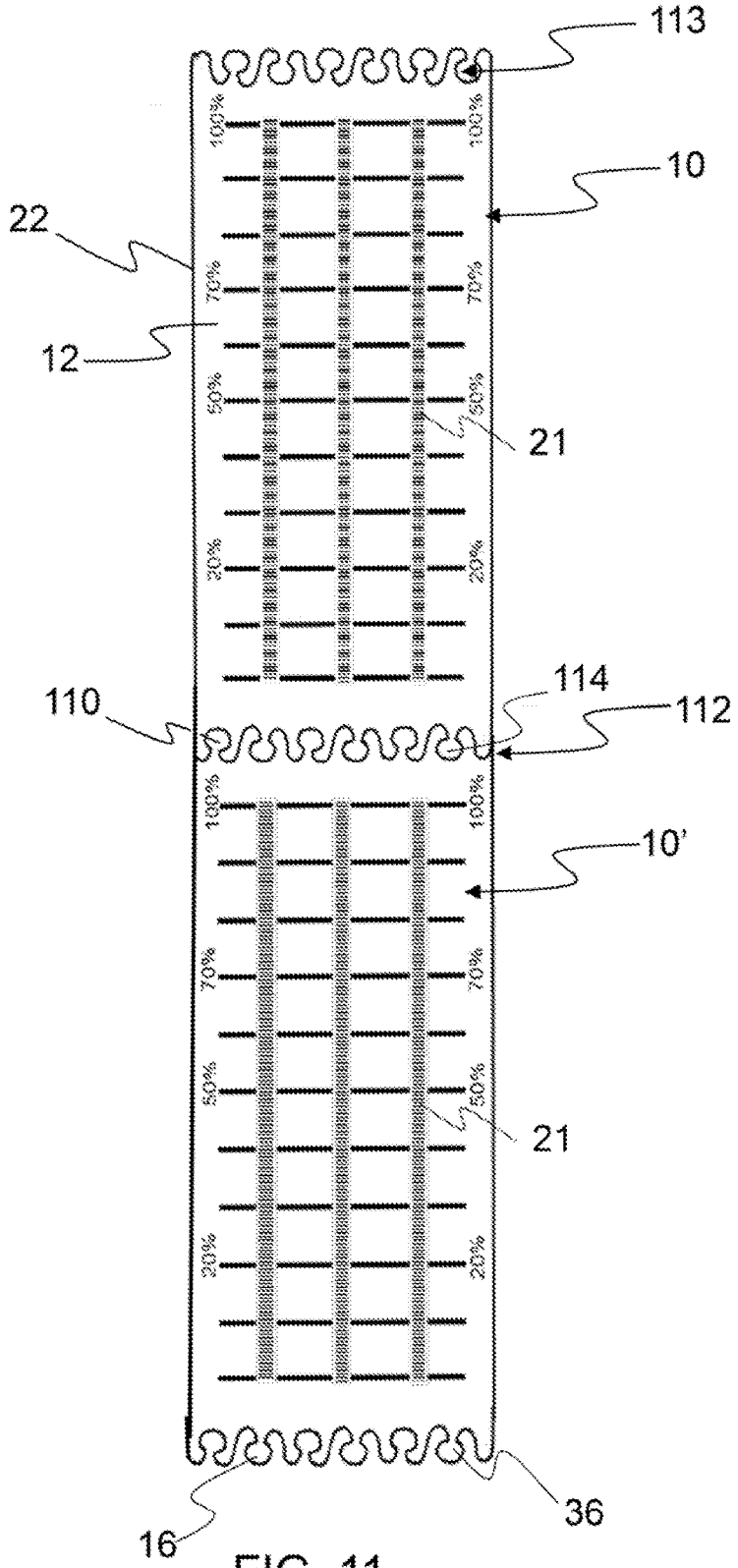

FIG. 11 shows a top view of two exemplary rehabilitation boards fastened together in a side-by-side configuration by puzzle piece type interlocking features.

Figure 12:
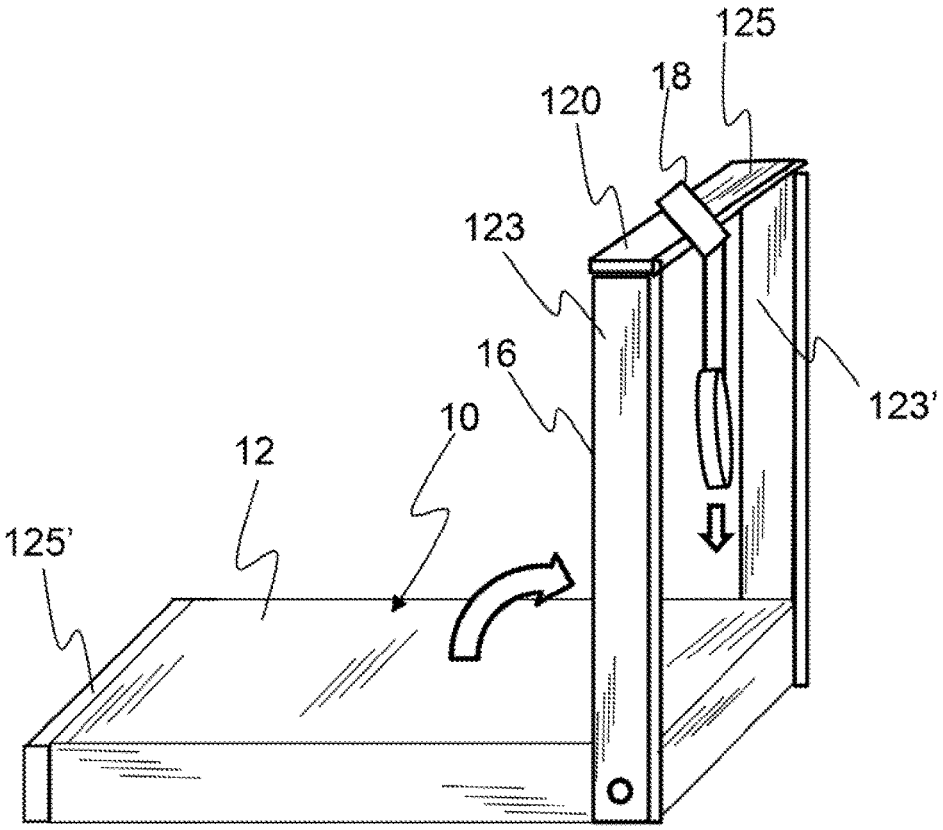

FIG. 12 shows an isometric view of an exemplary rehabilitation board having a vertical band retaining feature.

Figure 13:
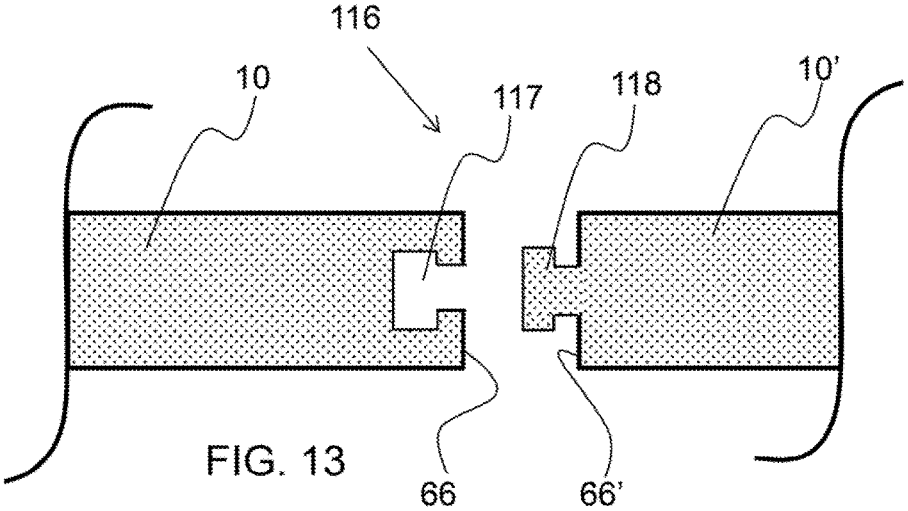

FIG. 13 shows a side cross-sectional view of an exemplary dove-tail type interlocking feature.

Figure 14:
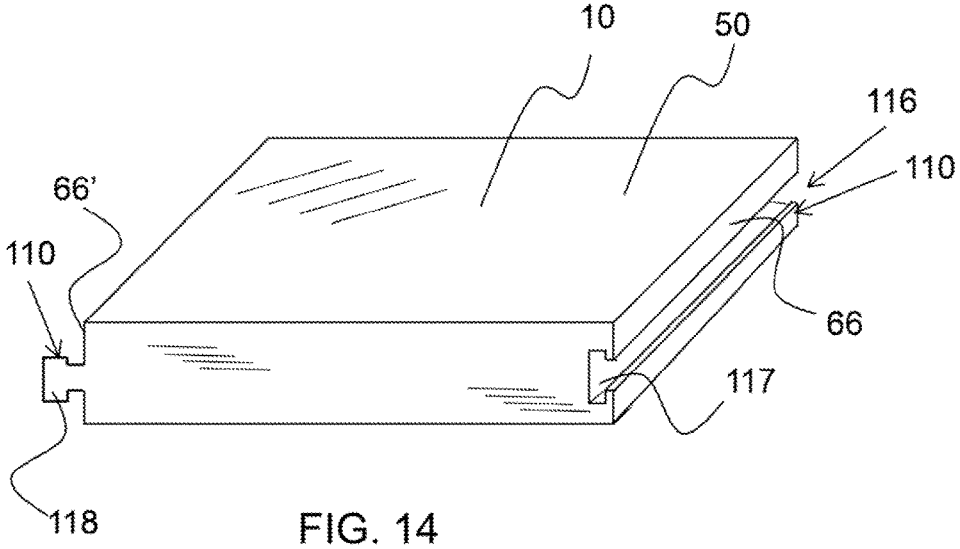

FIG. 14 shows an isometric view of a rehabilitation board having a dove-tail type interlocking feature on two opposing sides.

Figure 15A:
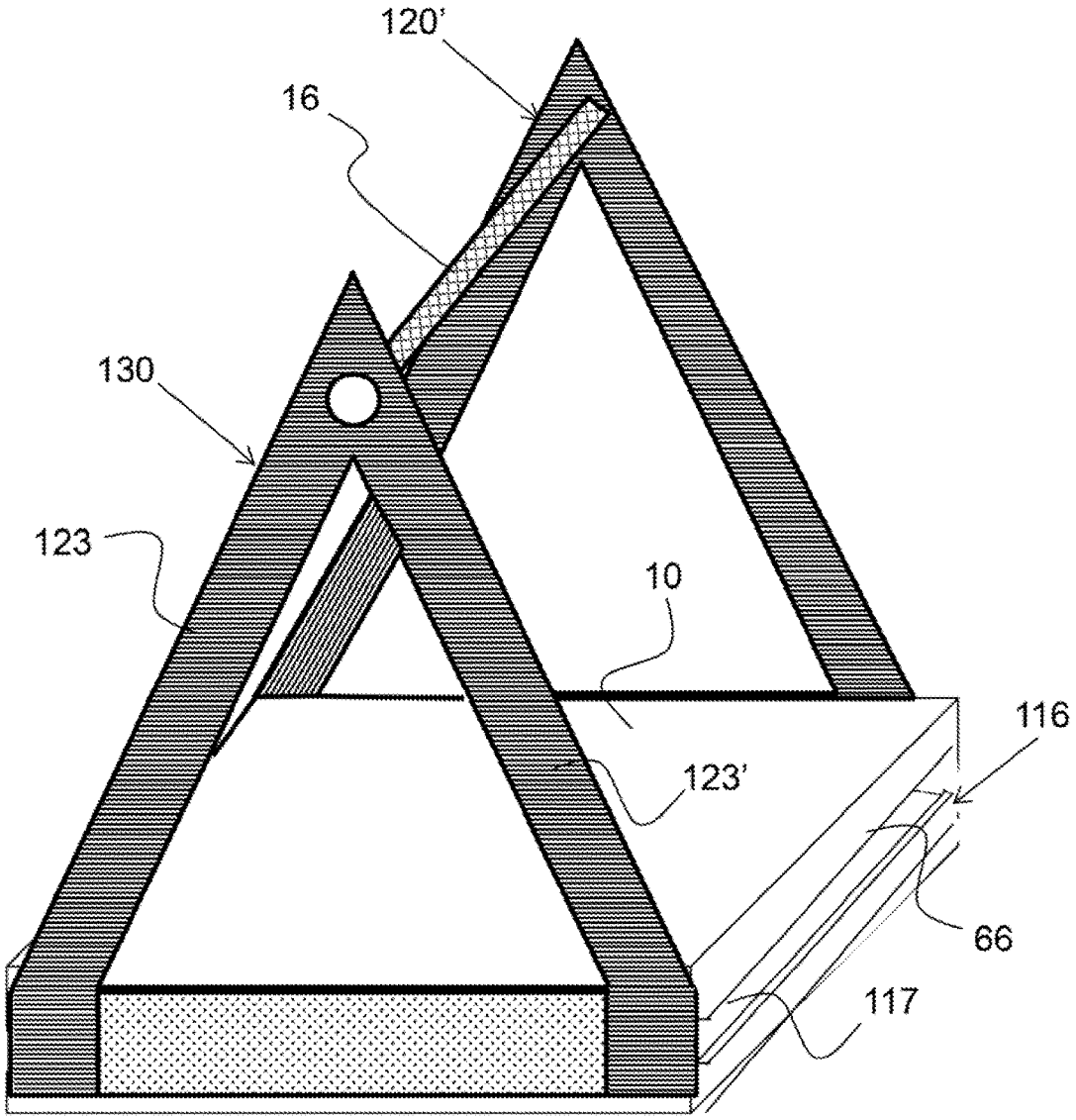

FIG. 15A shows an isometric view of a rehabilitation board having an A-frame type vertical band retaining feature attached thereto.

Figure 15B:
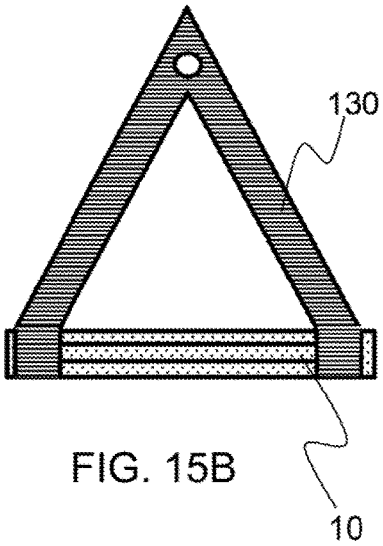

FIG. 15B shows a front view of a rehabilitation board having a detachable A-frame type vertical support member.

Figure 15C:
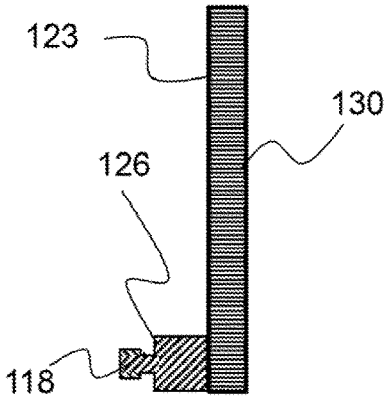

FIG. 15C shows a cross-sectional view of the detachable A-frame type vertical support member having a dove-tail type attachment feature.

Figure 15D:
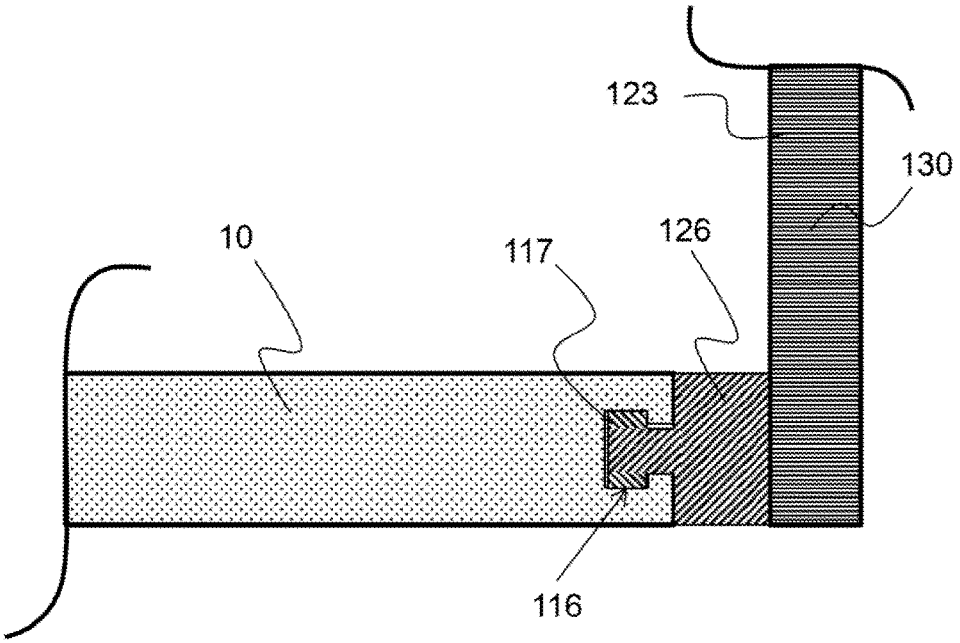

FIG. 15D shows an enlarged cross-sectional view of the detachable A-frame type vertical support member having a dove-tail type attachment feature.

Figure 16:
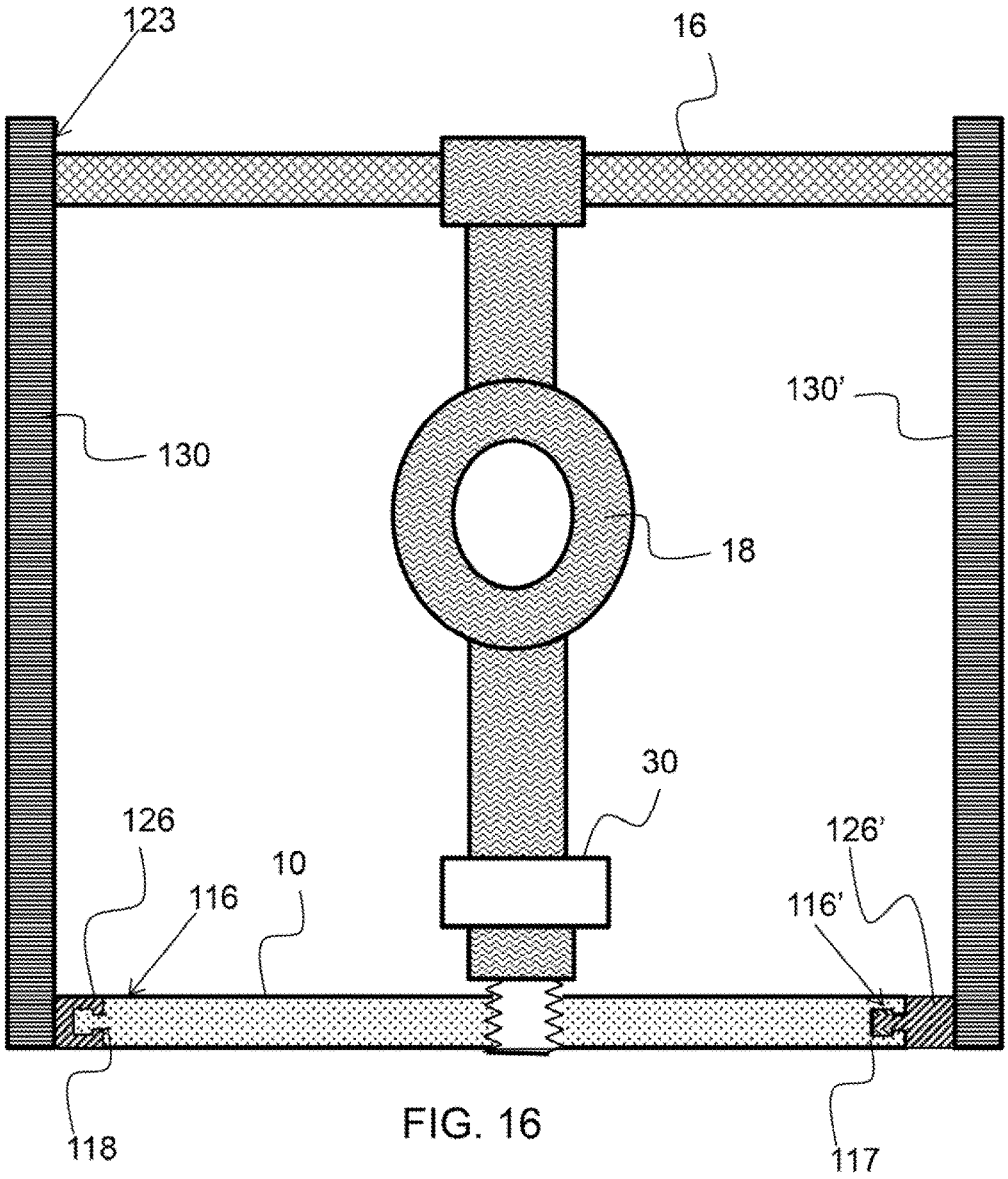

FIG. 16 shows a front cross-sectional view of the detachable A-frame type vertical support member having a dove-tail type attachment feature fastened to a rehabilitation board.

Figure 17A:
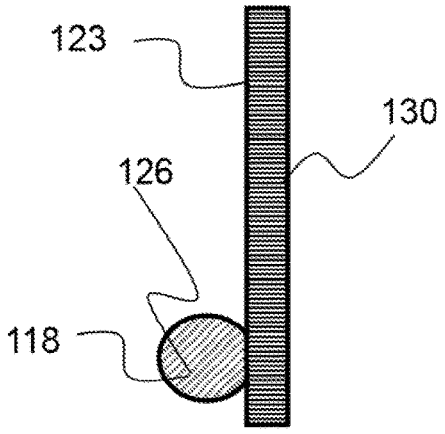

FIG. 17A shows a cross-sectional view of the detachable A-frame type vertical support member having a circular shaped dove-tail type attachment feature.

Figure 17B:
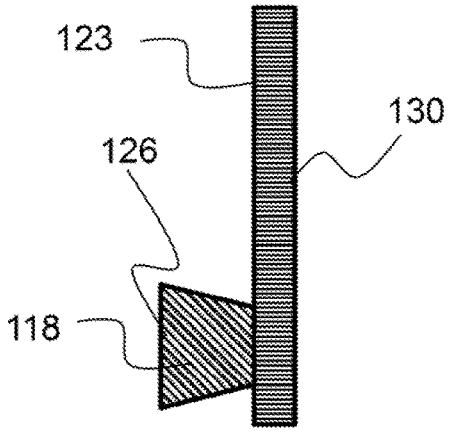

FIG. 17B shows a cross-sectional view of the detachable A-frame type vertical support member having a wedge shaped dove-tail type attachment feature.

Figure 17C:
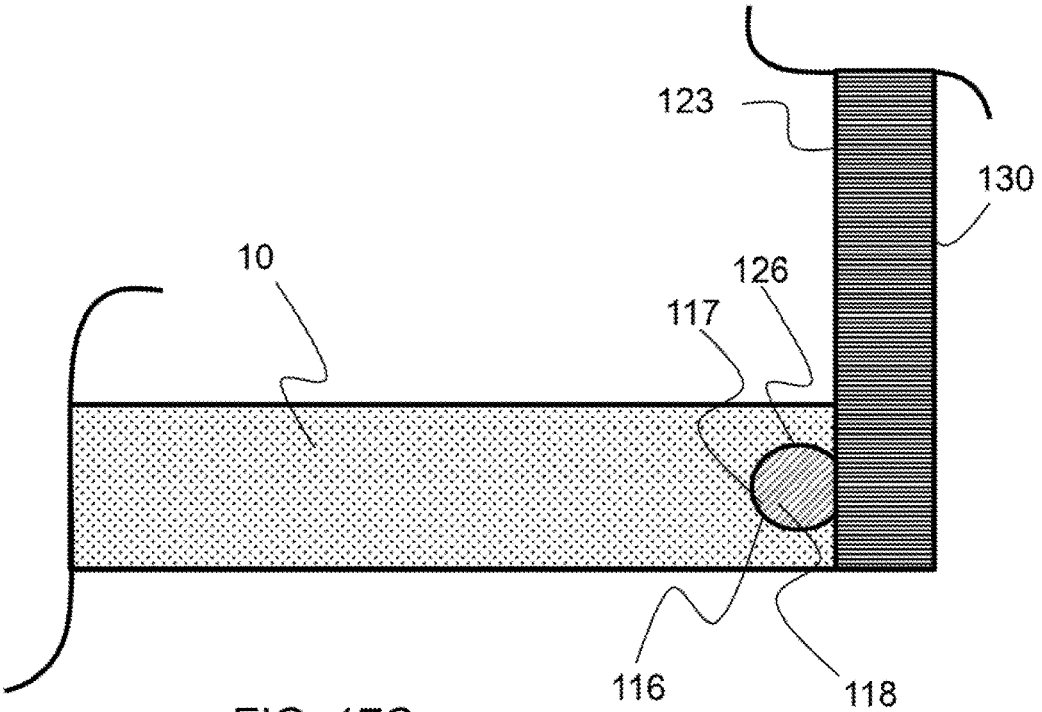

FIG. 17C shows an enlarged cross-sectional view of the detachable A-frame type vertical support member having a dove-tail type attachment feature fastened to a rehabilitation board.

Figure 18A:
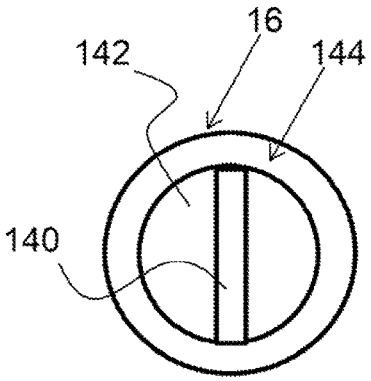

FIG. 18A shows a top down view of a post having a bar type band retaining feature configured in the top surface.

Figure 18B:
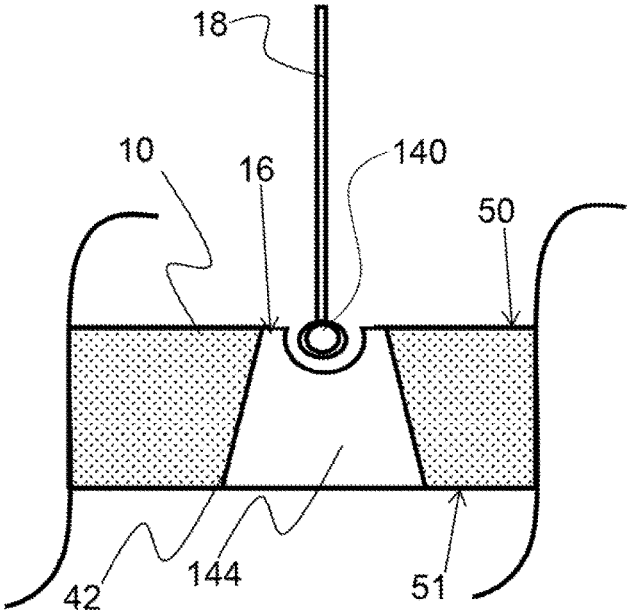

FIG. 18B shows a cross-sectional view of a rehabilitation board having a plug type post band retaining feature inserted into a post opening and a resistance band fastened thereto.

Figure 18C:
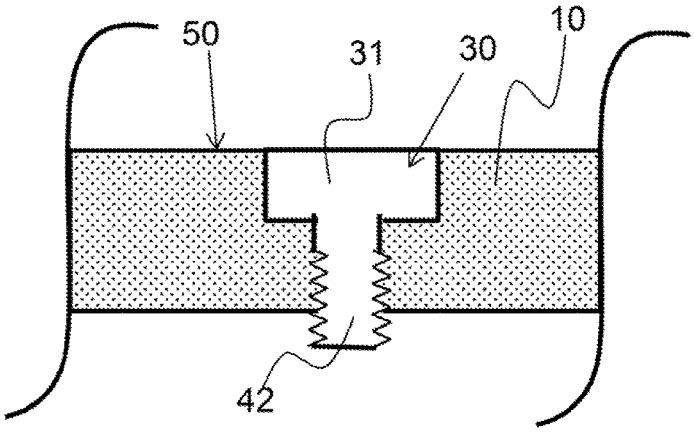

FIG. 18C shows a cross-sectional view of a rehabilitation board having a plug type post threaded into a post opening.

FIG. 19 shows a top view of an exemplary rehabilitation board having band retaining features along either end.

FIG. 20 shows a front-side view of the exemplary rehabilitation board shown in FIG. 19.

FIG. 21 shows a left-end view of the exemplary rehabilitation board shown in FIG. 19.

Figure 22:
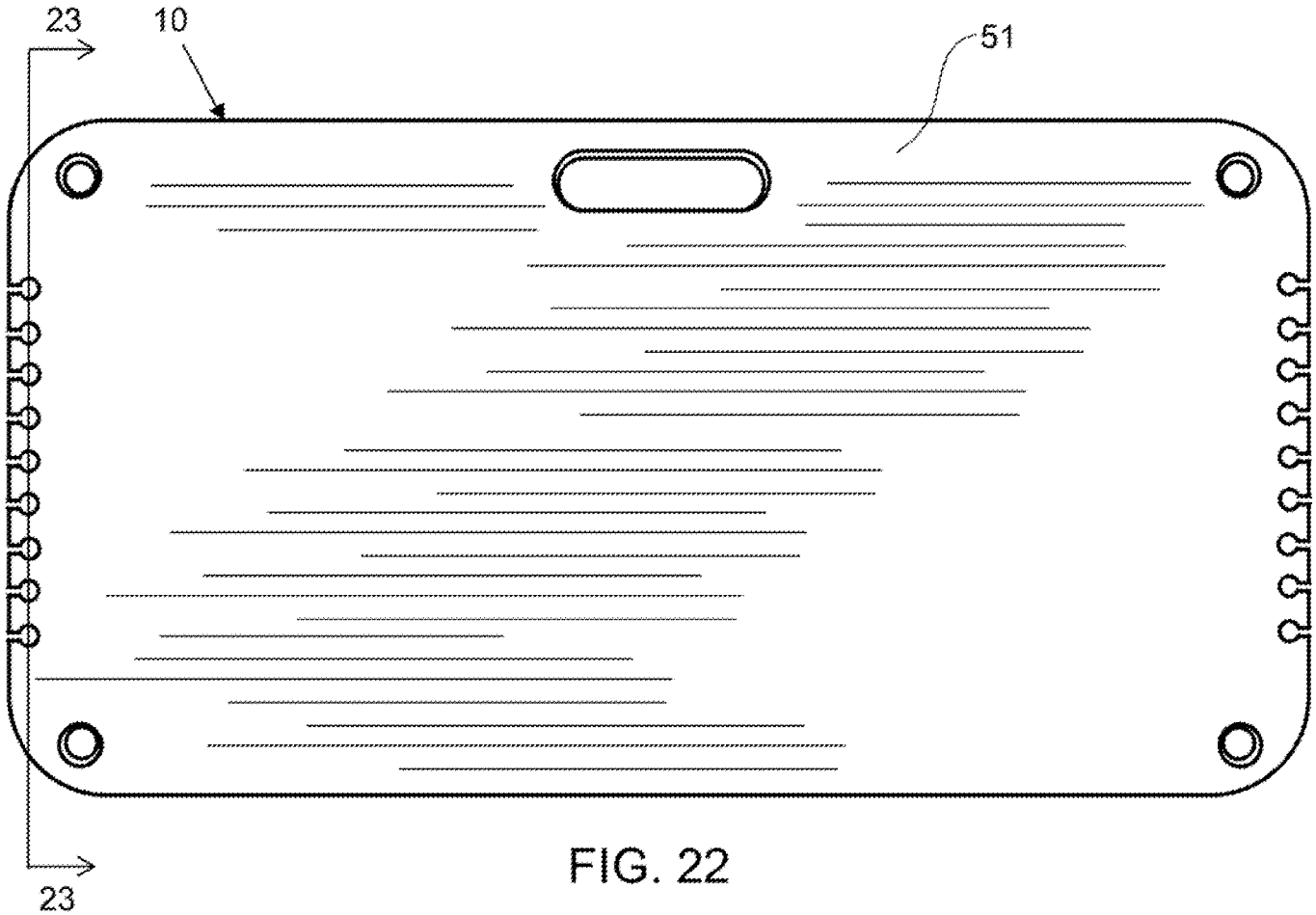

FIG. 22 shows a bottom view of the exemplary rehabilitation board shown in FIG. 19.

Figure 23:
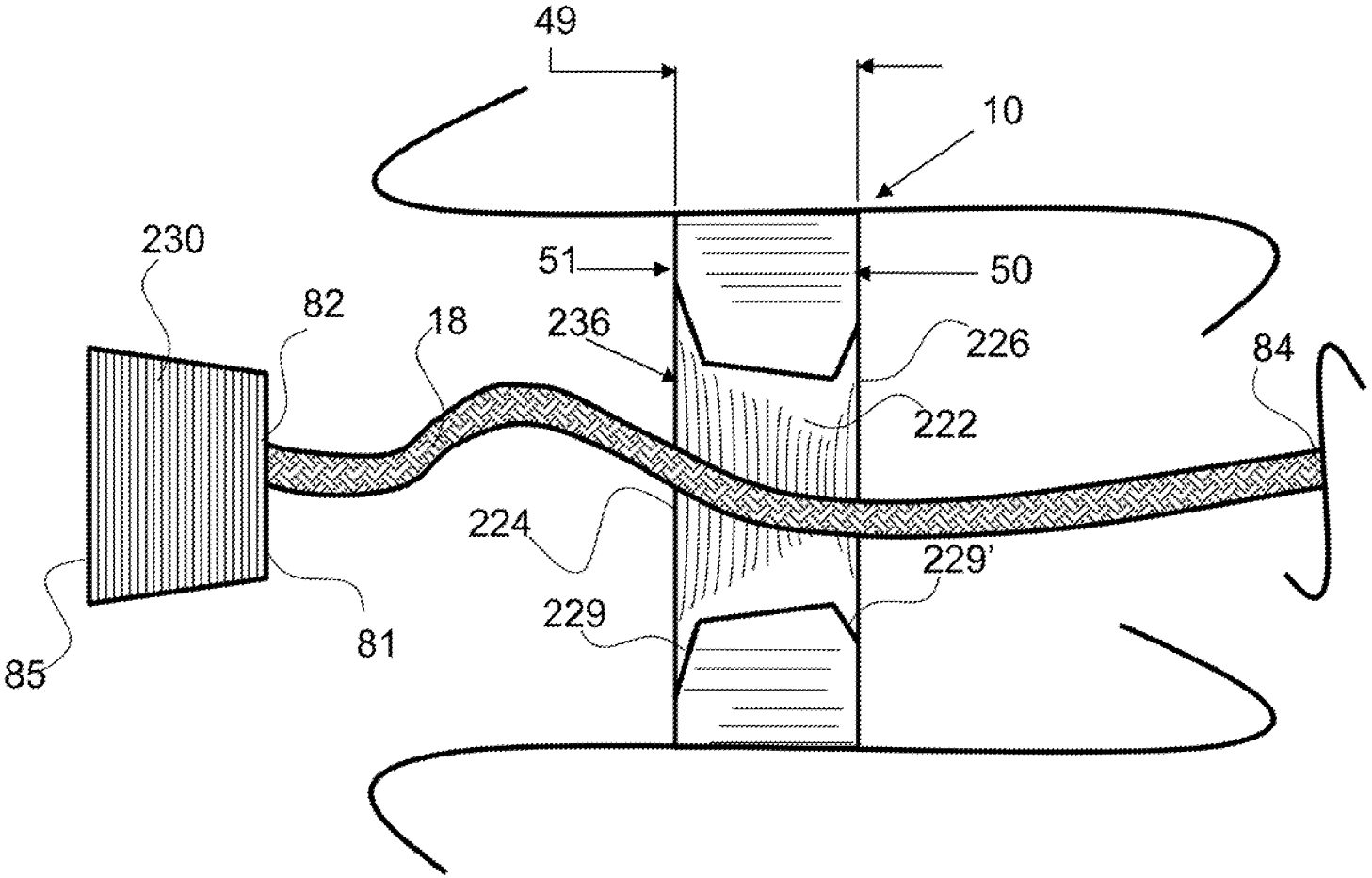

FIG. 23 shows an enlarged cross-sectional view of one of the attachment features taken along line 23-23 in FIG. 22, wherein the attachment feature comprises a conical shaped aperture through the thickness of the rehabilitation board.

Figures 24, 25, 26:
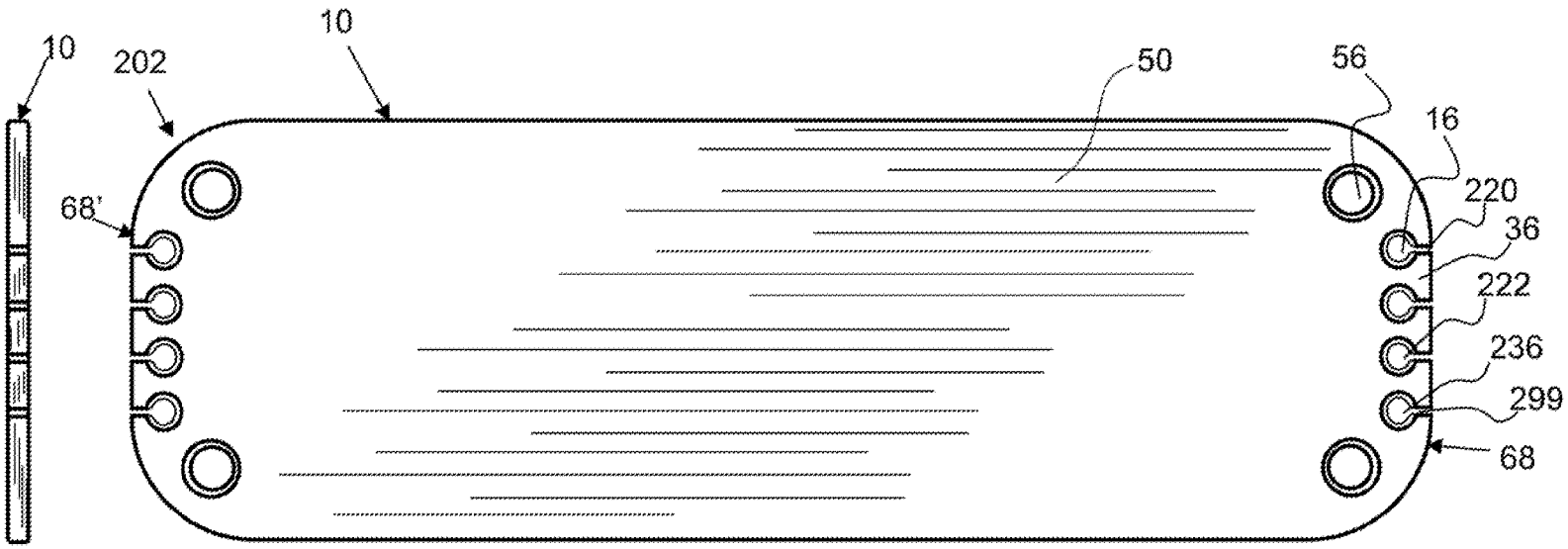

FIG. 24 shows a top view of an exemplary rehabilitation board having four band retaining features along either end.

FIG. 25 shows a front-side view of the exemplary rehabilitation board shown in FIG. 24.

FIG. 26 shows a left-end view of the exemplary rehabilitation board shown in FIG. 24.

Figure 27:
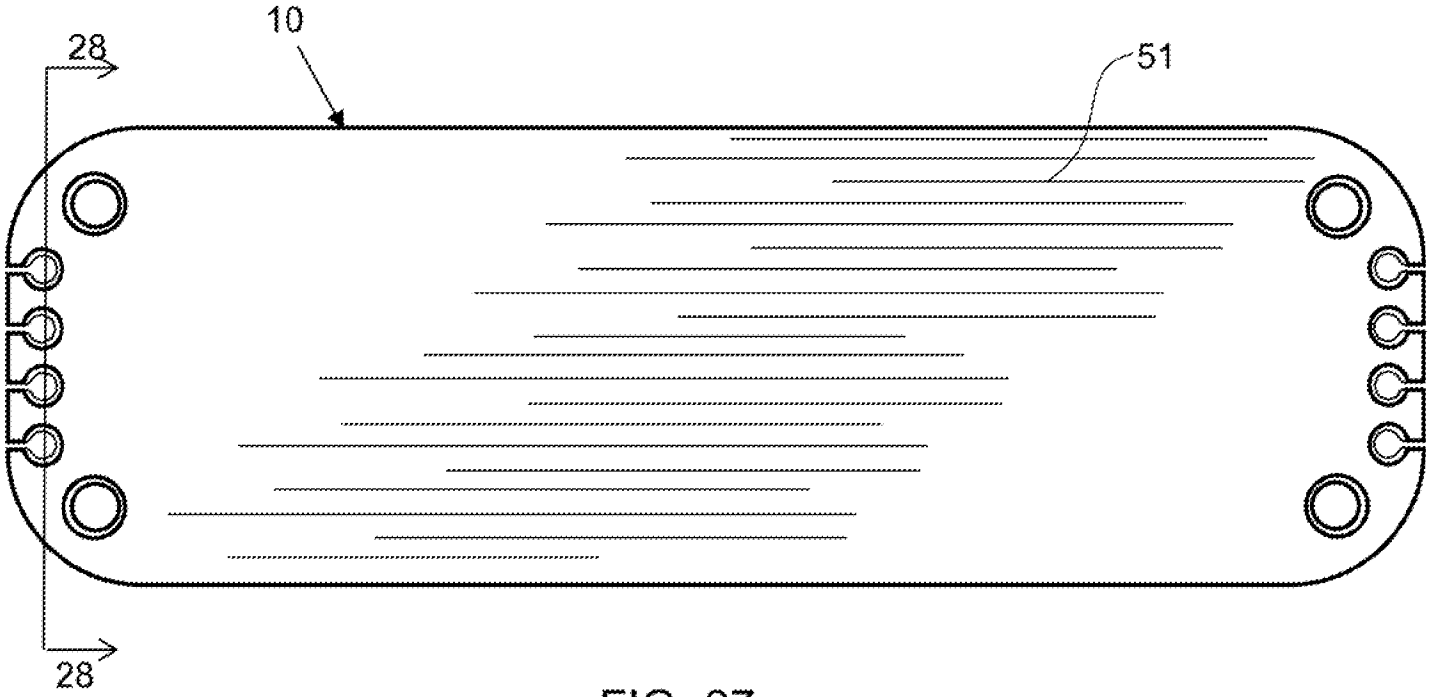

FIG. 27 shows a bottom view of the exemplary rehabilitation board shown in FIG. 24.

Figure 28:
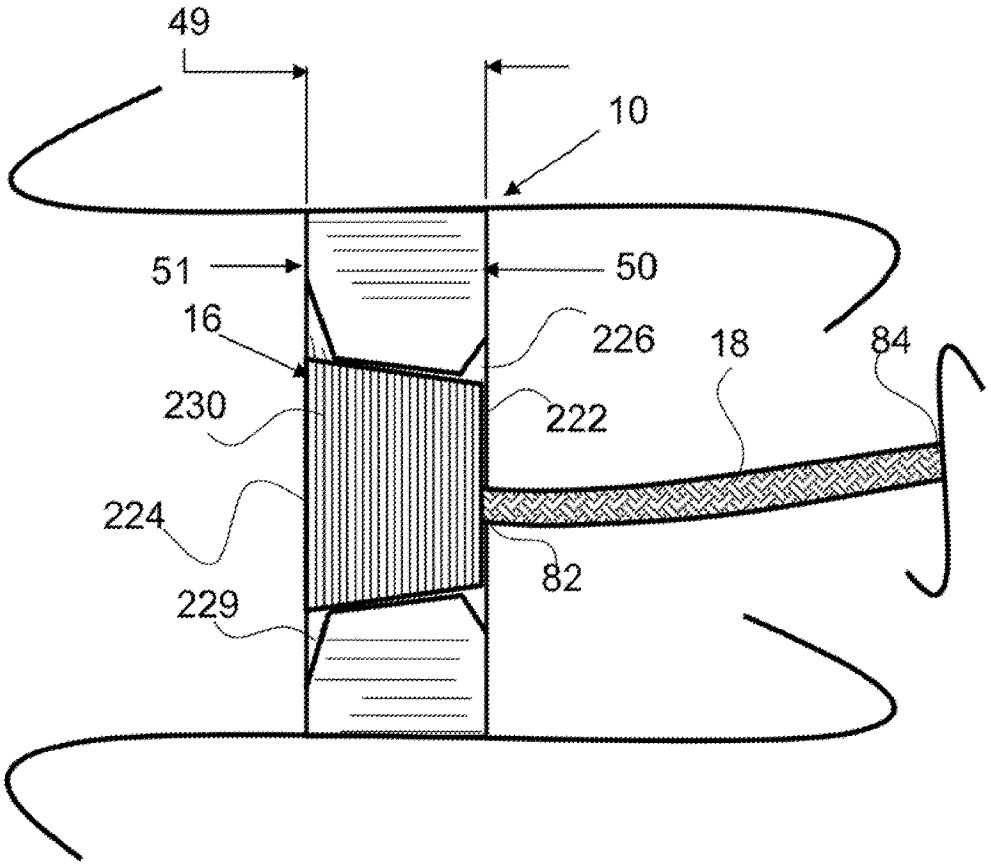

FIG. 28 shows an enlarged cross-sectional view of one of the attachment features taken along line 28-28 in FIG. 27, wherein the attachment feature comprises a conical shaped aperture through the thickness of the rehabilitation board.

Figure 29:
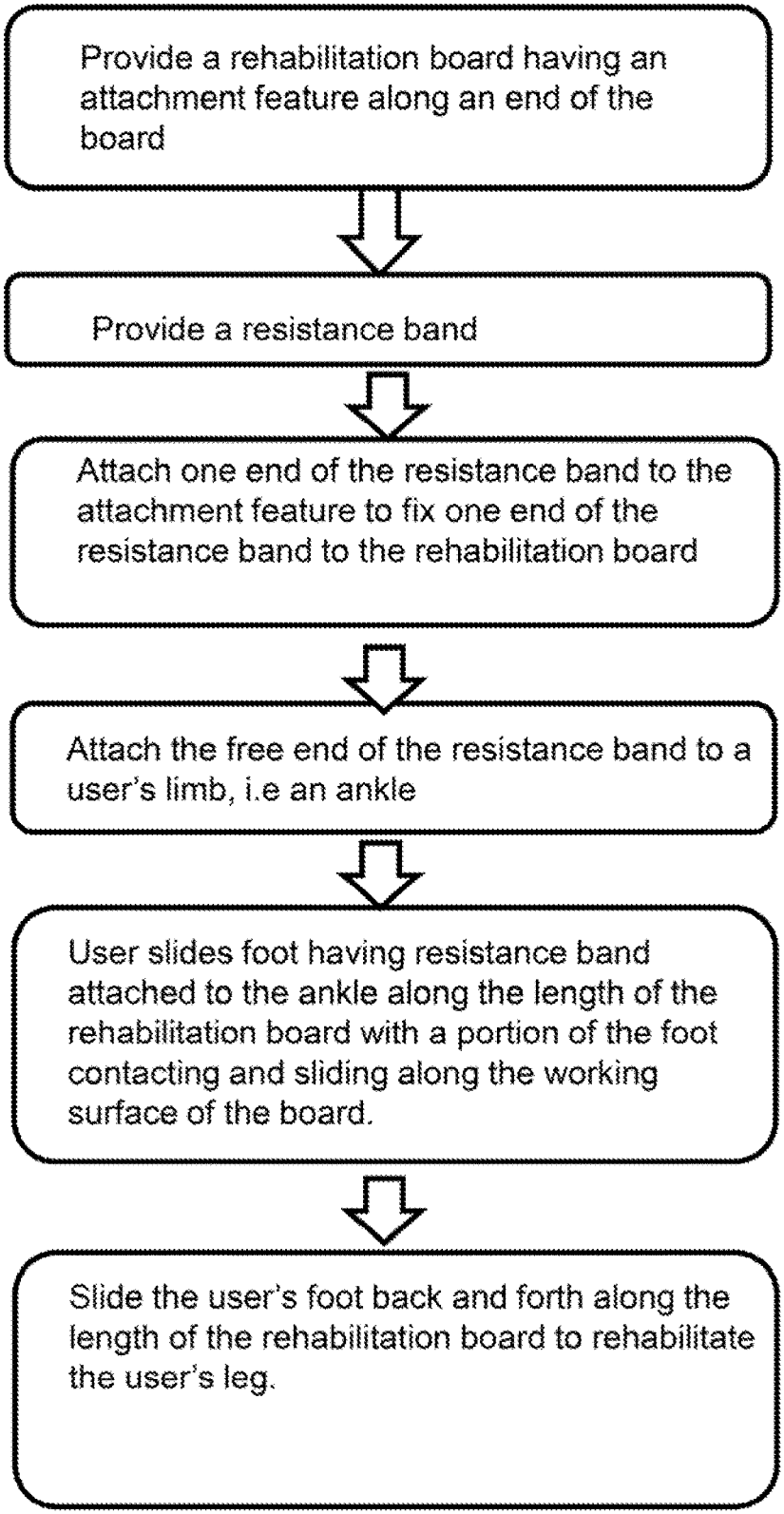

FIG. 29 is a flow chart of an exemplary method of the present invention.

Figure 30:
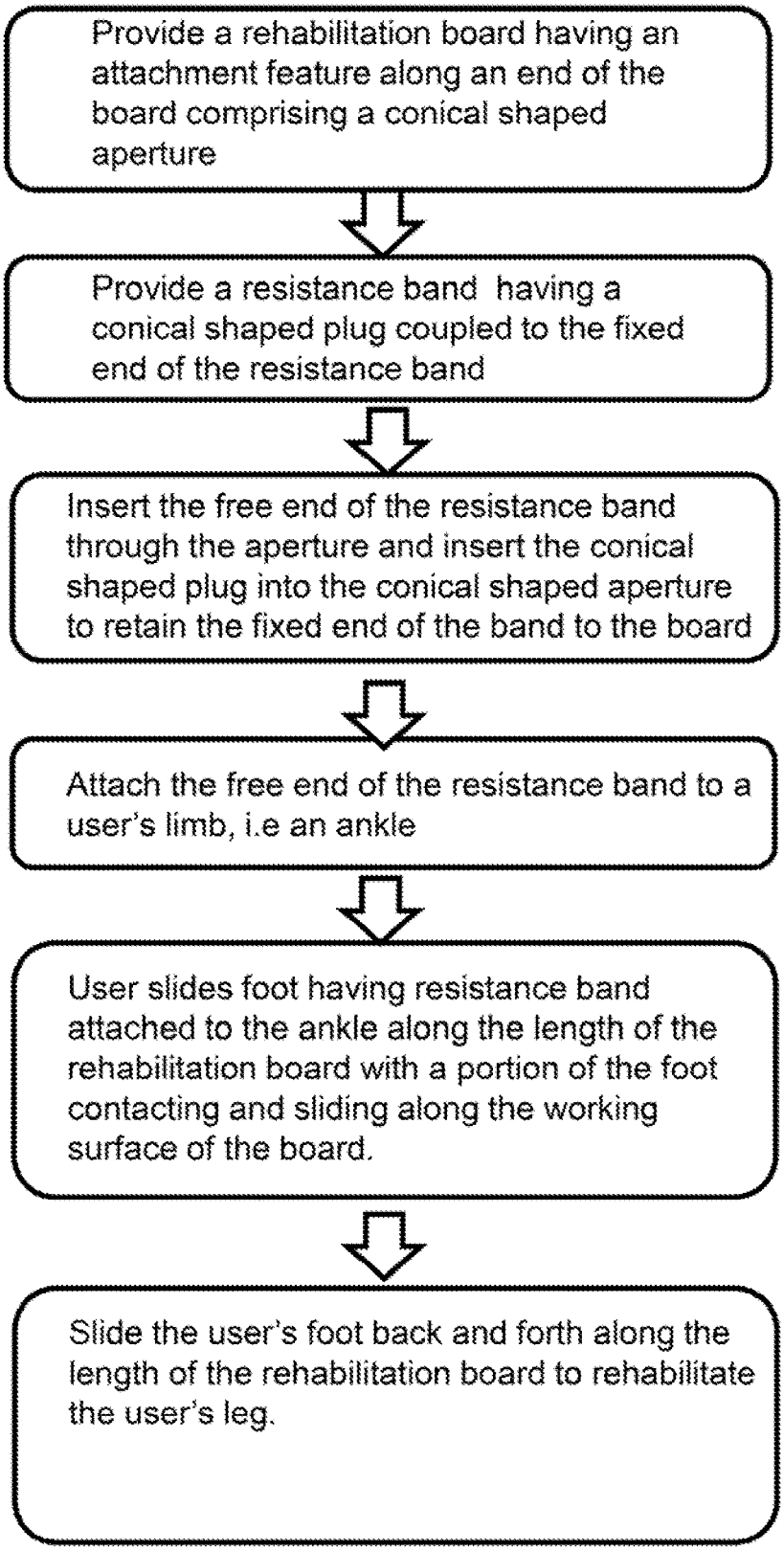

FIG. 30 is a flow chart of an exemplary method of the present invention.

Figure 31:
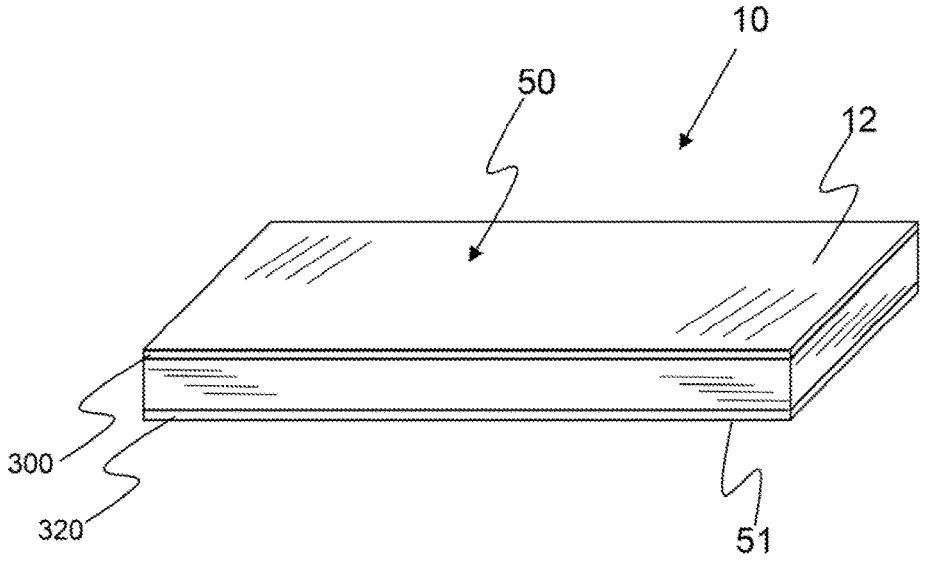

FIG. 31 shows an exemplary rehabilitation board having a detachably attachable low friction and non-slip layer.

Figure 32:
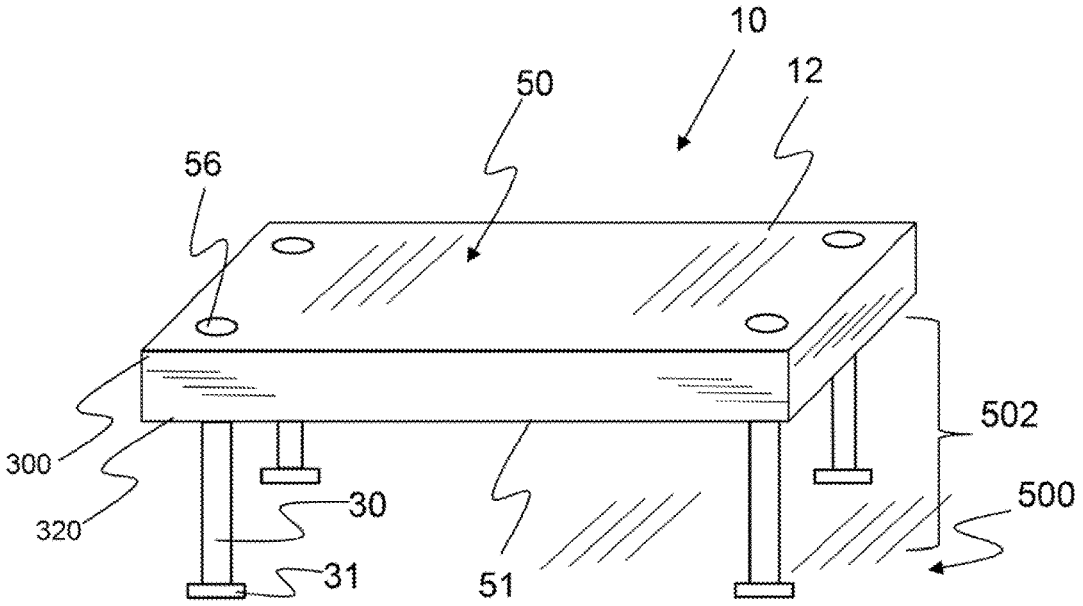

FIG. 32 shows an exemplary rehabilitation board having posts inserted into the peg openings from the bottom side of the rehabilitation board to elevate the rehabilitation board up from a base surface.

Figure 33:
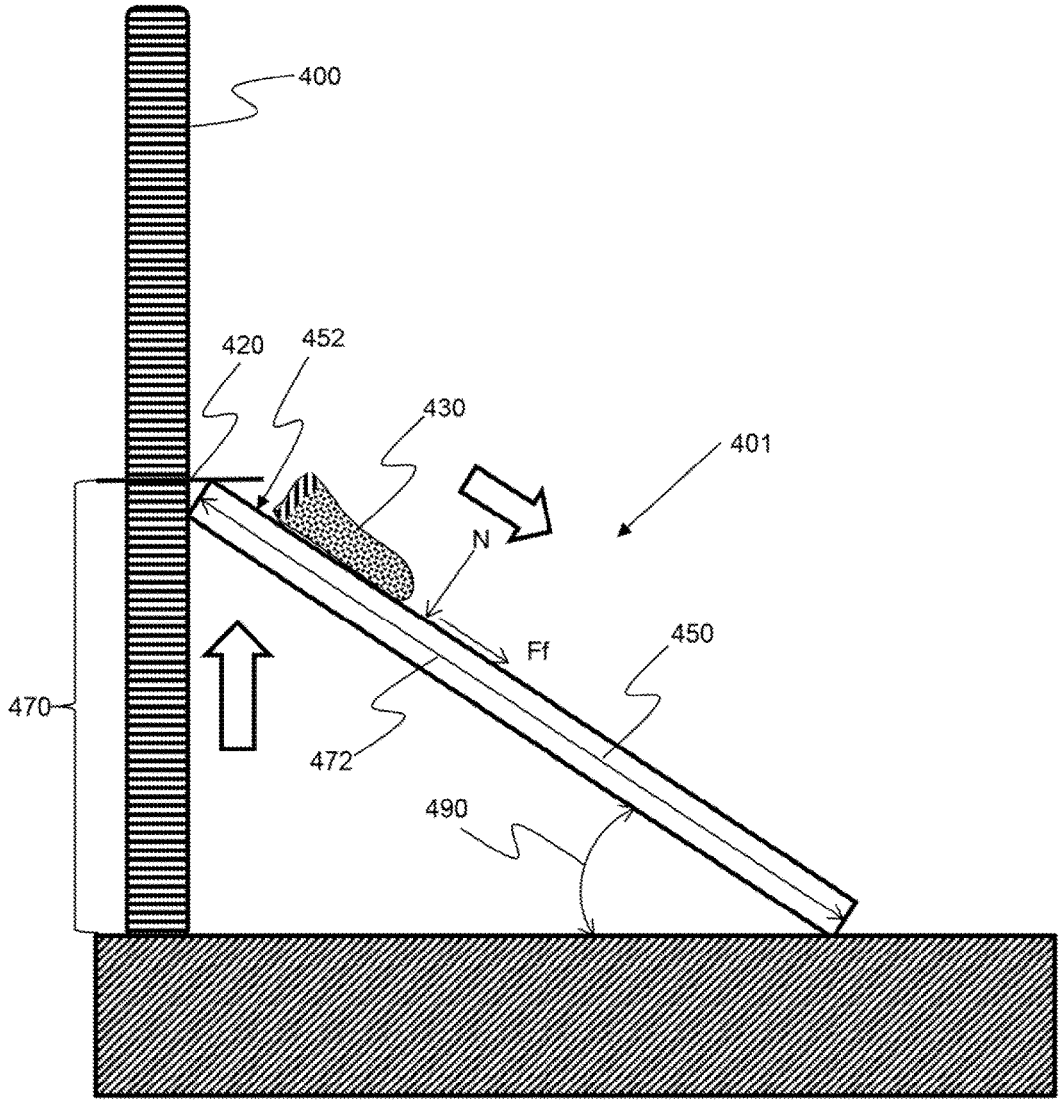

FIG. 33 shows a test apparatus for measuring the static coefficient of friction of a sand-filled sock along board surfaces.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and illustrated in the accompanying figures. The embodiments described are only for purposes of illustrating the present invention and should not be interpreted as limiting the scope of the invention. Other embodiments of the invention, and certain modifications, combinations and improvements of the described embodiments will occur to those skilled in the art and all such alternate embodiments, combinations, modifications, and improvements are within the scope of the present invention.

Definitions

Attached, as used herein, means that an object is fixed to and not easily removed from another object. For example a post that is attached to the rehabilitation board is not configured to be easily removed from the board.

Fastened, as used herein, means that an object is configured to be temporarily attached to, or detachably attached to another object. For example, a post that is a separate object from the rehabilitation board, may be fastened to the rehabilitation board by inserting one end of the post into an opening in the rehabilitation board or screwing the post into a threaded opening.

Band retaining feature, as used herein, is defined as a feature that is configured to retain at least one end of a resistance band and may comprise a nodule, post or opening through the board.

Integral, as used herein in reference to a band retaining feature, means that all components of the band retaining feature are attached to, are part of, or can be stored on the rehabilitation board. For example, a nodule that extends from the board is an integral band retaining feature. An opening in the rehabilitation board is an integral band retaining feature. A post that is attached to the rehabilitation board is an integral band retaining feature. A post that can be stored on or in the rehabilitation board is an integral band retaining feature.

Contiguous, as used herein in reference to a band retaining feature, means that the band retaining feature is integral and permanently attached to the rehabilitation board, such as nodules or posts that extend from the board, or openings in the rehabilitation board.

Calibrated, as used herein, in reference to range markings, means that the markings have a series of force markings that are calibrated with a resistance band type. In some embodiments, a band may be a color, such as red, and force range markings may be calibrated to that band type and may also be red in color. The force range markings may indicate a force that is approximately consistent with the force required to extend a band to that point.

Working surface, as used herein, refers to the surface and in most cases the top surface, of the rehabilitation board that is used for rehabilitation or exercise, and comprises a low coefficient of friction material.

Low static coefficient of friction material, as used herein, is a material that exhibits a static coefficient of friction of no more than about 0.50, or no more than about 0.30, which will allow the user to easily move a limb across the rehabilitation board.

The term board is used in reference to the rehabilitation board described herein.

EXAMPLE EMBODIMENTS

The invention is directed to a rehabilitation board 10 comprising a low friction material 12 on the working surface, and at least one band retaining feature 16. Optionally, the rehabilitation board may comprise a non-slip material (not shown) on at least a portion of the bottom surface and range markings 20 as shown in FIG. 1. The rehabilitation board may have a static coefficient of friction on the working or top surface of no more than about 0.50, which will allow the user to easily move a limb across the board without any additionally significant resistance. Low static friction is important for reducing start/stop friction as the user moves a limb back and forth over the board. The low friction board may also reduce or eliminate any chaffing or abrasion the user may experience after repetitive motion.

The rehabilitation board described herein may be any suitable dimension, having a length 47, width 48 and thickness 49 suitable for the required use, as shown in FIG. 6. For example, the rehabilitation board may be relatively large, such as about 1.8 m wide by about 1.8 m long or larger. In other embodiments, the board is smaller, such as about 61 cm wide by about 92 cm long by about 25 mm thick. However, the dimensions may be adapted to specific rehabilitation uses. The width may be between about 92 cm and 30 cm wide, or between 152 cm and 30 cm. The length may be between about 61 cm and 122 cm or between about 61 cm and 183 cm. The thickness may be between about 5 mm and 25 mm, or between about 5 mm and 50 mm.

The rehabilitation board described herein may be portable and sized such that it may be easily carried by a single individual, such as in a single hand. For example the board may be no more than about 1.5 meters long by 1.0 meters wide, or preferable no more than about 1 meter long by 1 meter wide, and in some embodiments no more than about 1 m long by about 0.5 m wide. A rehabilitation board may comprise a handle, such as an aperture extending through the board configured proximal to the edge of the board to allow a person to grab the handle with a single hand and carry the rehabilitation board.

In some embodiments, the rehabilitation board described herein is sized to allow the user to move a limb, such as a foot, over the board. In other embodiments, the board may be large enough to allow the user to lay on the board and move multiple limbs at one time. For example, a user may lay on a large rehabilitation board as described herein, and a band may be fastened to each of the user's legs. The user may then move both legs simultaneously to work and strengthen various muscle groups.

The rehabilitation board described herein may be planar, wherein no components or elements of the rehabilitation board extend or protrude from the working surface more than 10 mm.

The rehabilitation board 10 described herein may further comprise range markings 20 that allow the user or instructor to define a set motion goal including movement of a limb or extension of a resistance band to a specific range marking. Referring to FIG. 1 through FIG. 3, the range markings 20, may be simply a measured mark, such as line 21 or series of scaled lines, that can be used to more specifically instruct the user how far to extend a band 18, or move a limb. Furthermore, the range markings 20 may comprise percentage markings 22 to provide the user with some indication of degree of motion across the board. Any combination of range markings may be used on a rehabilitation board. As shown in FIG. 1, the rehabilitation board comprises a series of range markings 20 comprising lines 21 as well as percentage markings 22. The percentage indicator markings may be actual percentages or simply numbers scaled along the length of the rehabilitation board, such as numbers from 1 to 10, wherein the number 10 is located at the extended end of the board.

In one embodiment, the range markings may comprise force indicator markings 24 that are calibrated with a resistance band 18 as shown in FIG. 2A. For example, as shown in FIG. 2A, the red range markings 24' have force indicator markings from 0 to 50 lbs. These red force indicator markings 24' may be calibrated with a red resistance band 19, such that the user and instructor know how much force the user is exerting to extend the red band to a force indicator marking. The resistance board may have multiple force indicator markings which may be color calibrated with resistance bands of specific colors. For example, as shown in FIG. 2A, force indicator markings 24, 24', and 24", may be calibrated to three different band types and/or band colors. The force indicator range markings may be color coded for easy determination of force. For example, force indicator markings 24', may be red, force indicator markings 24 may be blue and force indicator markings 24" may be yellow.

Other inspirational or goal markings may also be incorporated into the rehabilitation board. For example, words such as "Way to go!" or "You can do it!" and the like may be included on the rehabilitation board to encourage the user to extend a band all the way to a certain marking, or to provide general inspiration during rehabilitation. In addition, other markings such as corporate logos may be included on the rehabilitation board. Markings of any type, including range markings, may be incorporated onto the rehabilitation board in any suitable manner including, but not limited to, printed, embossed, engraved, attached as stickers, laminated and the like. In another embodiment, a sound feature may be incorporated into the rehabilitation board described herein, and provide inspiration phrase as the user extends a band across the board.

The range markings may extend down in a direction substantially parallel with the length of the rehabilitation board, and/or may be at an angle to the length of the board. Range markings at an angle to the length of the rehabilitation board may be used for specific motions during rehabilitation or exercise.

In one embodiment, as shown in FIG. 3B, the opening type band retaining feature 32' may be located within the perimeter of the rehabilitation board. The range markings may have increasing values starting from a location within the perimeter of the board, such as approximately the center of the board, as shown in FIG. 3B. This configuration will allow for back and forth motion and an indication of force exerted in both directions.

Figure 9B:
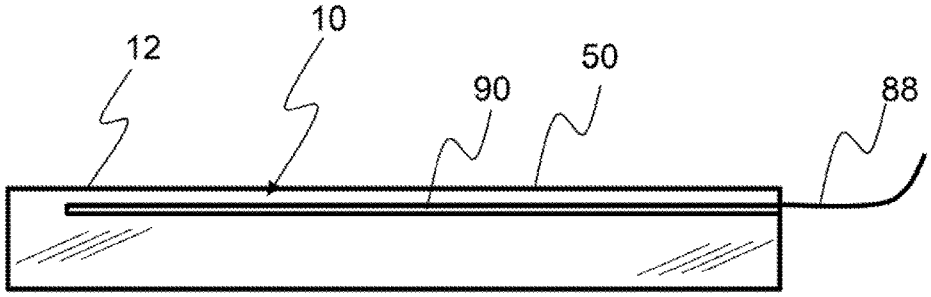

The range markings may be interchangeable, and may be on a material that can be fastened to the rehabilitation board. As shown in FIGS. 9A and 9B, a detachable scale 88, such as a sheet of material having range markings may be slid into a slot 90. The top surface of the rehabilitation board may comprise a transparent or translucent material such as PTFE film, that will allow the range markings to be seen through the top surface. In another embodiment, the range markings may be on a detachable scale material that may be fastened to and thereby become the top surface of the rehabilitation board. The material may comprise low friction materials, and may be fastened through any suitable means, including snaps, locating pins, snap, hook and loop fastening material, magnets, and the like. The range markings shown in FIGS. 9A and 9B are interchangeable range markings, whereby a plurality of detachable scales 88 may be interchanged as required for the application. In yet another embodiment, a smaller strip of material having range markings may be slid into or fastened to the rehabilitation board. In this embodiment, the line markings may be attached to the board and only the force or percentage makings, for example, may be interchanged.

The rehabilitation board described herein comprises at least one band retaining feature, and in some embodiments comprises two, three, four, five, six or more band retaining features. As shown in FIG. 1, band retaining features 16 extend from opposing ends of the rehabilitation board 10. FIG. 1 comprises six nodule type 36 band retaining features 16. A resistance band 18 may be tied around a band retaining feature 16 and a loop may be tied in the end extending from the band retaining feature. A resistance band may be a looped and/or a strip of material that may be tied in any conventional manner to a restraint band feature.

As shown in FIG. 2B, a user may place a limb, such as a foot 23, through the resistance band 18. The user may then extend and retract their foot as indicated by the arrows in FIG. 2B.

Referring to FIG. 4A through FIG. 8, the band retaining feature may comprise a post 30 that may be fastened to or attached to the rehabilitation board 10. In one embodiment, a post 30 may be attached to the rehabilitation board 10, rotated to various positions and secured in place as shown in FIG. 4A. FIG. 4A shows a post 30 that has been rotated up, as indicated by the arrows, from one side of the rehabilitation board 10. The post 30 shown in FIG. 4A may allow lateral movement of a limb across the board. The two posts 30, 30' shown in FIG. 4B and the configuration of the resistance band 18, may be used for vertical motion. In addition, the attached scale 86 shown in FIG. 4B comprises range markings 20. A resistance band 19 may be attached directly to a post or looped around two or more posts, as shown in FIG. 4B where the resistance band 18 is looped around posts 30' and 30" as shown in FIG. 4B. In some embodiments, a scale 86, may also be used as a post 30 or band retaining feature.

In yet another embodiment, the attached post may be rotated such that at least a portion of the post is recessed into the rehabilitation board. In another embodiment, a post 30 may be stored on or in the rehabilitation board. As shown in FIGS. 5A and 5B, a post 30 may be stored in the recesses 33 configured to accept the post. The post may be removed from the recesses and fastened into post openings as shown in FIG. 5A, where two posts have be inserted into post openings 42 in the rehabilitation board 10. The post recesses shown in FIG. 5B enable the rehabilitation board to be planar, as defined herein, when the posts are stored in the recesses. As shown in FIG. 6, the post 30 is a ring shape having both the first end 44 and second end 46 attached to the rehabilitation board. In addition, as shown in FIG. 6, a recess 33 in the board is configured to accept the post 30, wherein the post may be rotated into the recessed area.

The post may be any suitable shape or size. The post may be rectangular in shape as shown in FIG. 4A, or cylindrical as shown in FIGS. 5A and 5B, where the post is further configured with an enlarged portion 31 at the extended end or first end 44 to more securely retain a band 18. As shown in FIG. 6, the post is a ring segment shape, having both ends attached. In an alternative embodiment, the ring shaped post 30, as shown in FIG. 6 may be fastened to the rehabilitation board. The post should be robust enough to resist the force exerted on it without breaking. The post may be made out of any suitable material, including but not limited to wood, metal, polymer, or composite material.

The band retaining feature 16 may comprise at least one nodule 36 configured into or onto the rehabilitation board 10, such that a resistance band 18 may be tied to and/or looped around the nodule as shown in FIG. 1. The nodule may be a protrusion extending from the rehabilitation board, or configured from cut away or otherwise formed recesses in the rehabilitation board. For example, a nodule may be a protrusion extending in a direction perpendicular to the plane of the top or working surface of the board, or it may be configured in any side of the board and extend in a direction parallel with the plane of the top surface as shown in FIG. 1. The nodule may be of any shape and size suitable to retain a band and provide sufficient support during extension of the band. In one embodiment, the nodule comprises a curved portion 38 to which the band may be looped or tied. The curved portion 38 may reduce wear or breakage of the bands during extension. In addition, the nodule may comprise an enlarged portion 40 at the extended end, as shown in FIG. 1. The enlarged portion may more securely retain the band during exercises, especially those where there are sweeping or perpendicular movements from the plane of the surface of the board.

A band retaining feature may comprise an opening 32 that extends at least partially through the rehabilitation board 10 as shown in FIG. 3A and FIG. 3B. As shown in FIG. 3A, a band is tied into a loop and then configured through the center opening 32 along one end of the rehabilitation board. The band may be tied to or looped through an opening in any conventional way. In addition, the rehabilitation board may be configured with curved surfaces around an opening to reduce wear and prevent breaking of the band. An opening may be configured anywhere on the board, such as around the perimeter as shown in FIG. 3A, or more substantially within the working surface of the board, or approximately in the center of the board as shown in FIG. 3B. As shown in FIG. 8A, band retaining features may comprise a combination of retaining features, where a post 30 comprises an opening 32 whereby a band may be secured, for example.

As shown in FIGS. 7A and 7B, a post restraint opening 42 in the rehabilitation board 10 may be used to fasten a band retaining feature, such as a post 30. In addition, as shown in FIG. 7A, the opening 42 may also be used to secure the rehabilitation board 10 to a fixed object 60. The second end 46 of the post 30 may be inserted into the rehabilitation board 10, such that the second end extends completely through the board and into an opening 62 in the fixed object 60.

In an alternative embodiment, a band retaining feature 16 may be rotated or otherwise fastened to the rehabilitation board in a manner that provides a post type band retaining feature 30, and a securing feature 64, as shown in FIG. 8A. In one embodiment, the band retaining feature 16, as shown in FIG. 8A, is rotated and pinned into position. The post in FIG. 8A may be rotated and fixed into a position where a band may be secured to it, and where the opposing end may be used to secure the rehabilitation board 10 to a fixed object 60, such as the end of a table.

In another embodiment, as shown in FIG. 88B, the band retaining feature 16 may further comprise a securing feature that restrains the board from vertical movement. The horizontal extended portion 65 of the securing feature 64 may be configured to slide under a fixed object 60.

A band retaining feature 16 may be located in any suitable location on the rehabilitation board 10, such as on the working surface 50, side surfaces 66, 66', or may protrude from one or more ends 68, as shown in FIG. 6. In one embodiment, at least one band retaining feature is located on each end of the rehabilitation board. In another embodiment, at least one band retaining feature is located on the working surface of the rehabilitation board in close proximity to each end. In one embodiment, two band retaining features are located on either end of the rehabilitation board, and in another embodiment, three band retaining features are located on each end of the rehabilitation board. In yet another embodiment, a band retaining feature is located in approximately the center of the rehabilitation board.

The rehabilitation board described herein may comprise a non-slip material that is fastened or attached to the low friction board. The bottom surface 51, of the rehabilitation board may comprise a non-slip material 14, as shown in FIG. 6. The non-slip material 14 may cover the base of the low friction board 12, or at least a portion of the base of the low friction board, such as one or more strips of non-slip material 14, 14' as shown in FIG. 6. The non-slip material may be attached to the low friction board through the use on any conventional means including but not limited to adhesives, fasteners and the like. In one embodiment the non-slip material is attached to another material such as a board that may be fastened to the low friction board. The non-slip material may comprise any suitable material, including but not limited to, pressure sensitive adhesives, silicones, urethanes, rubbers, and the like. The non-slip material may comprise Dycem non slip material, such as Dycem Part # NSOS/PA, available from Dycem Ltd. (Warwick, R.I.), which is well known to provide non-slip properties on a wide variety of surfaces.

In another embodiment, the rehabilitation board may be secured in place using suction cups, magnets or any other suitable means. For example, straps may be used to retain the rehabilitation board to a structure, such as a table. Bands or straps may be retained in the integral band retaining features and configured to or around a fixed object to secure the rehabilitation board is a fixed position.

The rehabilitation board may further comprise a securing feature for more positively securing the board in a location. In one embodiment, the securing feature 64 comprises a peg 54 that may be inserted through a peg opening 56 in the rehabilitation board 10 and into another opening 62 configured in a permanent fixture 60 as shown in FIGS. 2A and 2B. In another embodiment, a peg attached or fastened to a permanent fixture may be at least partially inserted into an opening in the rehabilitation board. For example, two pegs in permanent fixture may be configured to align with openings in the base of the rehabilitation board wherein the rehabilitation board may be located over the pegs and pressed down and secured. In yet another embodiment, the securing feature comprises a peg or wedge that may be fastened to the board and forced against or around a permanent fixture.

An extension indicator 100 may be configured onto the rehabilitation board to allow the user and instructor to more accurately determine the extension a user achieves with a resistance band. As shown in FIG. 10A, an extension indicator 100 extends across the rehabilitation board such that as a user extends the band 18, such that the extension indicator 100 will slide easily along the board. The extension indicator may be fastened to one or more edges of the rehabilitation board, and may extend only a portion of the distance across the board. In one embodiment, the extension indicator may be easily slid off the end of the board and stored in or on the board. The extension indicator may be fastened to the rehabilitation board in any conventional way, such as with a fastening portion 102, as shown in FIGS. 10B and 10C. FIG. 10B shows the fastening portion 102 as C-channels, 104 and 104' that are configured to slide around the board. A narrow base portion 106 may accommodate and allow for the easy movement of the C-channel 104 type fastening portion 102. As shown in FIG. 10C, a T-slot 108 type fastening portion 102, may be formed into the rehabilitation board 10. In another embodiment, a T-slot type fastening portion may be formed in a separate piece of material that is attached or fastened to the rehabilitation board.

A dynamic indicator having a measuring function, may be used with the rehabilitation board as described herein. A force or range dynamic indicator may be attached or fastened to the rehabilitation board in any suitable manner. A force type dynamic indicator may record the amount of force exerted when a band is extended, and one end of a resistance band may be attached to a dynamic indicator. A range type dynamic indicator may be used to record that distance or range that a resistance band is extended. A range indicator may comprise a wheel that turns as a user extends a band, thereby measuring the distance the band was extended. A dynamic range indicator may be fastened to a rehabilitation board using a band retaining feature, such as a threaded opening, for example. In addition, an extension or dynamic indicator may be fastened to a dove-tail type interlocking feature as described herein.

In some circumstances, a given length of board may not be sufficient for the extension of some users. As shown in FIG. 11, the rehabilitation boards 10 and 10', may be configured with interlocking features 110. Like a puzzle piece, one or more sides of a rehabilitation board may be configured with puzzle piece type interlocking features 112. As shown in FIG. 11, two rehabilitation boards, 10 and 10' have been fastened together by puzzle piece type interlocking features 112, thereby doubling the length. The puzzle piece type interlocking feature 112 comprises puzzle piece protrusion 114 and puzzle piece recesses 113. This geometry may also be a band retaining feature 16, where a puzzle piece protrusion 114, may act also as a nodule type 36 band retaining feature 16. It is conceived that the interlocking features may be configured on more than one side, such as on all four sides of the rehabilitation board, and thereby provide for modular arrangement of the boards. For example, four rehabilitation boards having interlocking features on all four sides may be configured into a two by two arrangement, thereby doubling the length and width of a single board. Any number of arrangements may be configured. In addition, any number of board interlocking features may be used, such as, but not limited to, puzzle piece type interlocking features, dove-tail type interlocking features, hook and loop fasteners, pins, interference fit edge portions, and the like. In one embodiment, the interlocking feature configuration would provide for no increase in thickness along the interlocking area and the low friction property of the working surface would be maintained. Both the puzzle piece and dove-tail type interlocking features are configured to provide for a smooth planar transition from a first board to second board.

In one embodiment, the rehabilitation board 10 may comprise a vertical resistance band retaining feature 120 as shown in FIG. 12. The two vertical support members, 123 and 123' may be pinned elements along the edges of the rehabilitation board 10. The horizontal support member 125 may be attached to the horizontal members and be configured to nest along the perpendicular edge or end of the rehabilitation board. In another embodiment a separate support member 125' may be detached from the rehabilitation board and fastened across the two raised vertical support members, 123 and 123'. A resistance band 18 may then be fastened to the vertical band retaining feature 16, and a user may then place a limb into the band and extend the band downward as shown by the arrow in FIG. 12.

FIG. 13 shows a side cross-sectional view of an exemplary dove-tail type interlocking feature 116 comprising a dove tail recess 117 in a first rehabilitation board 10 and a dove-tail 118 protruding from a side 66' of a second rehabilitation board 10'.

FIG. 14 shows an isometric view of a rehabilitation board 10 having a dove-tail type interlocking 116 feature on a first side 66, and a dove-tail 118 on a second opposing side 66'. A plurality of rehabilitation board having the interlocking feature 110 shown in FIG. 14 could be fastened together to form an extended working surface 50.

FIG. 15A show an isometric view of a rehabilitation board 10 having an A-frame type 130 vertical band retaining feature attached thereto. The A-frame type vertical band retaining feature 130 comprises two vertical support members 123, 123'. A band retaining feature 16 is configured between the two A-frame type vertical band retaining features 120. A band 18 (not shown), may be attached to the band retaining feature and allow a user to extend the band downward. An A-frame type vertical band retaining feature comprises two vertical support members that are connected at an apex, and the vertical support members may be fastened to the rehabilitation board in any suitable way.

FIG. 15B shows a front view of a rehabilitation board 10 having an A-frame type vertical band retaining feature 130, fastened thereto. FIG. 15C shows a cross-sectional view of the detachable A-frame type vertical support member 130 shown in FIG. 15B having an attachment feature 126. The attachment feature comprises a dove-tail type configuration as described herein, but could comprise any suitable attachment configuration, including a puzzle piece type interlocking type configuration. The attachment feature may be an integral part of the vertical support member 123, or may be a separate part that is attached to the vertical support member. In addition, the attachment feature may extend along the entire length of the side of the rehabilitation board between the two vertical support members, thereby providing more rigidity and support.

FIG. 15D shows an enlarged cross-sectional view of the detachable A-frame type vertical support member 130 having a dove-tail type attachment feature 126.

FIG. 16 shows a front cross-sectional view of the detachable A-frame type 130 vertical support member 123 having a dove-tail type attachment feature 126. The band retaining feature 16 is configured between the two A-frame type vertical support members 130, 130'. A band retaining feature may be fastened to one, or between two or more vertical support members. A post 30 is shown having threads that are used to fasten the post to the rehabilitation board 10. A resistance band 18 is configured around the post and around the band retaining feature 16. The band 18 comprises a ring configured between the two retained ends. A user could place their hand or foot through the ring and move the limb both up and down with resistance.

FIG. 17A shows a cross-sectional view of the detachable A-frame type 130 vertical support member having a circular shaped dove-tail 118 type attachment feature 126. This dove-tail shape may be incorporated into an interlocking feature as described herein.

FIG. 17B shows a cross-sectional view of the detachable A-frame type 130 vertical support member having a wedge shaped dove-tail 118 type attachment feature 126. This dove-tail shape may be incorporated into an interlocking feature as described herein.

FIG. 17C shows an enlarged cross-sectional view of the detachable A-frame type 130 vertical support member having a dove-tail type attachment feature 126 fastened to an dove-tail type interlocking feature 116 of a rehabilitation board 10. An interlocking feature may be used to attach any suitable type of device, support, band retaining feature, indicators and the like.

FIG. 18A shows a top down view of a plug type 144 post 30 having a bar 140 configured in the top surface. The bar 140 is configured over a recess 142 in the top surface of the plug 144, as shown in FIG. 18B. A band 18, is fastened around the bar 140, as shown in FIG. 18B. As shown in FIG. 18C a plug type post 144 is inserted through the bottom surface of the rehabilitation board in this embodiment. The plug type post is conical in shape having a smaller diameter end that is inserted through bottom surface 51 of the rehabilitation board 10. The outer surface of the conical shaped plug type post 144 is configured to be retained in the corresponding conical shaped post opening 42. The outer surface of the conical shaped plug type post interfaces with the surface of the post opening 42, whereby the plug cannot be pulled through the board from the bottom to the top or working surface.

FIG. 18C shows a cross-sectional view of a rehabilitation board 10 having a plug type post 30 threaded into a post opening 42. The top surface of the plug type post provides a substantially flush working surface 50.

FIGS. 19 to 22 show an exemplary rehabilitation board 10 having a peg opening 56 proximal to each of the corners 202 of rehabilitation board and nine band retaining features 16 along either end 68, 68'. The rehabilitation board is substantially rectangular in shape with rounded corners. Each of the band retaining features comprises a slot 220 that extends in from the end of the board to an aperture. The exemplary aperture in this embodiment is a conical shaped aperture 222, comprising a tapered aperture through the thickness 49 of the rehabilitation board having a larger bottom surface opening 224 along the bottom surface 51 of the rehabilitation board that tapers in dimension as the tapered aperture extends through thickness of the rehabilitation board to a smaller working surface opening 226 on the working surface 50, as shown in FIG. 23. This type of aperture may be referred to as a band plug retainer as it is configured to retain a band plug attached to a resistance band. The conical shaped aperture also comprises beveled openings 229, 229' on the bottom and working surfaces, respectively. Between each of the slots is a nodule type 36 band retaining feature 16 comprising an enlarged portion 40 that may be used to retain a retainer band, such as by tying thereto or fixing a looped end there around. Each end of the rehabilitation board therefore comprises a plurality of resistance band plug retainers, the conical shaped opening, and a nodule type band retainer feature 36. This configuration provides versatility in how the rehabilitation board is used.

FIG. 23 shows an enlarged cross-sectional view of one of the plug type attachment features 236, or band plug retainer, taken along line 23-23 in FIG. 22, wherein the attachment feature comprises a conical shaped aperture 222 through the thickness 49 of the rehabilitation board. A tapered or conical shaped plug 230 is configured at the fixed end 82 of the resistance band 18. The free end 84, or end that is coupled to a user's limb extends through the conical shaped aperture 222. The outer surface of the conical shaped plug 230 is configured to interface with the inner surface of the conical shaped aperture 222 to secure the fixed end of the resistance band to the rehabilitation board 10. The tapered plug 230 has a band end 81 that is smaller in dimension than the retainer end 85. The enlarged retainer end is larger is dimension across the exposed face of the retainer end then the opening at the working surface 50 of the tapered or conical shaped aperture 222.

FIGS. 24 to 27 show an exemplary rehabilitation board 10 having a peg opening 56 proximal to each of the four corners 202 and four band retaining features 16 along either end 68, 68'. As shown in FIG. 24, the integral band retaining features extending from the first and second ends are dual band retaining features 299, comprising a nodule 36 that extends directly out from the end of the rehabilitation board and a band plug retainer that comprises a tapered aperture through the thickness of the board, as shown in more detail in FIG. 28. The dual band retaining feature enables a resistance band to be looped or tied around the nodule or a resistance band plug to be inserted into the band plug retainer. The slots between the nodules leads to the band plug retainer aperture.

As shown in FIG. 28, a conical shaped plug 230 is retained within the conical shaped aperture 222. The fixed end 82 of the resistance band 18 is retained by the conical shaped plug 230 and the free end 84 extends out from the working surface 50 for attachment to a user's limb. The band surface of the conical shaped plug is flush with the working surface 50 and the opposing surface of the plug is substantially flush with the bottom surface 51 of the rehabilitation board.

FIG. 29 is a flow chart of an exemplary method of the present invention. A resistance band may be retained to the attachment feature by tying one end of the resistance band around a nodule, or looping a loop of the resistance band around a nodule, or by tying a knot in the resistance band and securing it on the bottom side of an aperture that restricts the knot from pulling through the aperture.

FIG. 30 is a flow chart of an exemplary method of the present invention that includes securing a conical shaped plug into a conical shaped aperture.

FIG. 31 shows an exemplary rehabilitation board 10 having a detachably attachable low friction layer 300 and detachably attachable non-slip layer 320. As described herein, a detachably attachable low friction and/or non-slip layer may comprise cut-outs and/or apertures configured to align with post or peg opening or band retaining features of the rehabilitation board.

FIG. 32 shows an exemplary rehabilitation board 10 having posts 30 inserted into the peg openings 56 from the bottom side of the rehabilitation board to elevate the rehabilitation board up from a base surface 500 an elevation height of 502. Enlarged portions of the post 31, act as feet for the elevated rehabilitation board 10. As described herein, elevating the board may allow a user to place a leg or arm under the board and the other leg or arm on the working surface for the purposes of rehabilitation. For example, a user may place a first leg under the elevated rehabilitation board and the other, or second leg, on the working surface, or on top of the rehabilitation board. The user may then slide the second leg across a portion of the working surface of the rehabilitation board for rehabilitation. A slide lying hip flexion or gravity eliminating hip flexion are examples of exercises that may be performed with the leg scissoring the elevated rehabilitation board FIG. 33 show a test apparatus 401 for measuring the static coefficient of friction of a sand-filled sock 430 along board surfaces 452.

Example 1: Friction Test

Various boards, including exemplary rehabilitation boards, as described herein, were evaluated for static coefficient of friction. A test apparatus, as shown in FIG. 33 was used for these tests. To simulate the friction that may be encountered during rehabilitation exercises, a sock (69% cotton, 29% nylon 2% spandex, product no. SX5703-101-large,) was filled with 1 Kg of sand. The sand-filled sock 430 was then placed on a test board 450 proximal to a vertical measuring post 400. The vertical measuring post comprised distance indicia 420, to determine the height 470 at which the sand-filled sock began sliding down the test board. The height 470 and length of the board 472 can be used to determine the incline angle 490 at which the static coefficient is overcome between the board surface 452 and the sand-filled sock 430. The equation is provided by:

$$\text{Incline angle}=\sin^{-1}(\text{height/board length})$$

The coefficient of static friction, Ks, between the sand-filled sock and the board surface 452 can be is expressed by:

$$Ks=F_f/N$$

where Ff is the friction force along the surface of the board and N is the normal force to the board.

The friction force is calculated by equation:

$$F_f=1\text{ kg sin (Incline angle)};$$

and the normal force is calculated by:

$$N=1\text{ kg cos (incline angle)}.$$

The following board surfaces were evaluated, high density polyethylene (HDPE), a PTFE skived tape was adhered to the high density polyethylene board, cabinet grade plywood, and an ultra-soft microfiber 100% polyester sheet was laid over and pulled taught over the plywood. The coefficient of static friction, Ks, for each of the board surface is provided in Table 1.

TABLE 1

| Board Surface | Height (in) | Board Length (in) | Ks |
|---|---|---|---|
| PTFE | 6 | 36 | 0.169 |
| HDPE | 10 | 36 | 0.289 |
| Plywood | 16 | 36 | 0.496 |
| Polyester sheet | 20.5 | 36 | 0.692 |

The PTFE and HDPE board surfaces had less than half the static coefficient of to the plywood and polyester sheet.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A method of rehabilitating a user's limb comprising the steps of:

a) providing a portable rehabilitation board comprising:
- a length of no more than 1.5 m from a first end to a second end;
- a width;

wherein the rehabilitation board is substantially rectangular in shape having four corners;
- a top working surface of the rehabilitation board having a static coefficient of friction with itself of no more than about 0.25 according to ASTM 1894;

wherein the static coefficient of friction is effectively low to enable a user's limb to slide easily across the working surface;
- a first integral band retaining feature comprising a nodule that extends directly out from the first end of the rehabilitation board; and
- a second integral band retaining feature comprising a nodule that extends directly out from the second end of the rehabilitation board,
- a non-slip material configured on a bottom surface, opposite the top working surface of the rehabilitation board;

wherein the rehabilitation board is portable having a size such that it may be easily carried by a single individual, b) providing a resistance band having a fixed end and an extended end;

c) attaching the fixed end of said resistance band to one of said integral band retaining features;

d) coupling the extended end of the resistance band to said user's limb;

e) extending said user's limb along the length of the rehabilitation board;

wherein a portion of the user's limb is in contact with the top working surface of the rehabilitation board and slides along the top working surface; and f) repeating step e) to rehabilitate the user's limb.

2. The method of rehabilitating a user's limb of claim 1, wherein the fixed end of the resistance band is retained around the nodule extending from the first end.

3. The method of rehabilitating a user's limb of claim 1, wherein the user's limb is a leg having a knee, an ankle and a foot, and the extended end of the resistance band is coupled around a user's ankle; and wherein the user slides said foot along the low friction surface of the rehabilitation board from a first position proximal to the first end along the length of the rehabilitation board to a second position that is more proximal to the second end than said first position, thereby extending the knee to rehabilitate the user's knee.

4. The method of rehabilitating a user's limb of claim 1, wherein the rehabilitation board comprises range markings configured on the working side of the rehabilitation board;

wherein the range markings are configured in intervals along the length of the rehabilitation board to indicate a degree of extension of the user's limb along the length of the working surface; and whereby the method further comprises the step of observing the degree of extension that the user's limb is extended across the rehabilitation board, wherein the user slides said user's limb along the length of the low friction surface of the rehabilitation board from a first position proximal to the first end and a first range marking, along the length of the rehabilitation board to a second position that is more proximal to the second end than said first position and to a second range marking, thereby extending the user's limb from a first range marking to second range marking.

5. The method of rehabilitating a user's limb of claim 4, wherein the range markings comprise percentage indicator markings that correspond with a percentage of at least a portion of the rehabilitation board length.

6. The method of rehabilitating a user's limb of claim 4, wherein the range markings comprise force indicator markings that are calibrated with the resistance band; and wherein the step of observing the degree of extension that user's limb is extended across the rehabilitation board further comprises determining a force exerted by said user to extend the user's limb to one of said force indicator markings.

7. The method of rehabilitating a user's limb of claim 6, wherein the range markings are interchangeable range markings wherein the range markings may be detachably attached to the rehabilitation board; and wherein the interchangeable range markings comprise force indicator markings that correspond with a resistance band extension metric, whereby a force is indicated for an extension of the resistance band along the length of the rehabilitation board.

8. The method of rehabilitating a user's limb of claim 1, wherein the nodules of the first and second integral band retaining features comprise an enlarged portion at an extended end of the nodule.

9. The method of rehabilitating a user's limb of claim 1, comprising two or more integral band retaining features extending from both the first and second end of the rehabilitation board.

10. The method of rehabilitating a user's limb of claim 9, wherein the two or more band retaining features each comprise a slot extending in from said end of the rehabilitation board to a circular shaped aperture.

11. The method of rehabilitating a user's limb of claim 1, wherein the fixed end of the resistance band comprises a tapered plug having an enlarged plug dimension at a plug-end that tapers to a smaller dimension at a band-end of the tapered plug; and wherein the first integral band retaining feature is a dual retainer feature comprising a band plug retainer comprising a tapered aperture through the thickness of the rehabilitation board having a larger bottom surface opening along the bottom surface of the rehabilitation board that reduces in dimension as the tapered aperture extends through thickness of the rehabilitation board to a smaller working surface opening; and whereby the step of attaching the fixed end of said resistance band to one of said integral band retaining features comprises:

inserting the band-end of the tapered plug into the band plug retainer to attach the fixed end of said resistance band to said first integral band retaining feature or the second band retaining feature.

12. The method of rehabilitating a user's limb of claim 1, wherein a first rehabilitation board is configured with a puzzle piece type interlocking feature comprising a plurality of protrusion that extend from at least one side of the rehabilitation board and are configured to fit into a plurality of recess of a second rehabilitation board; and wherein the method further comprises the step of coupling a first rehabilitation board having a first length to a second rehabilitation board having a second length by fitting the plurality of protrusions of interlocking feature into the plurality of recesses in the second rehabilitation board to produce a coupled rehabilitation board having a combined length of the first length and second length.

13. A method of rehabilitating a user's limb comprising the steps of:

a) providing a portable rehabilitation board comprising:

a length of no more than 1.5 m from a first end to a second end;

a width;

a thickness;

wherein the rehabilitation board is substantially rectangular in shape having four corners;

a top working surface of the rehabilitation board having a static coefficient of friction with itself of no more than about 0.25 according to ASTM 1894;

wherein the static coefficient of friction is effectively low to enable a user's limb to slide easily across the working surface;

a first integral band retaining feature comprising a nodule that extends directly out from the first end of the rehabilitation board; and a second integral band retaining feature comprising a nodule that extends directly out from the second of the rehabilitation board, a peg opening configured through the thickness of the rehabilitation board;

a non-slip material configured on a bottom surface, opposite the top working surface of the rehabilitation board;

wherein the rehabilitation board is portable having a size such that it may be easily carried by a single individual, b) providing a resistance band having a fixed end and an extended end;

c) coupling the fixed end of said resistance band to the peg opening;

d) coupling the extended end of the resistance band to said user's limb;

e) extending said user's limb along the length of the rehabilitation board;

wherein a portion of the user's limb is in contact with the top working surface of the rehabilitation board and slides on the low friction surface;

f) repeating step e) to rehabilitate the user's limb.

14. The method of rehabilitating a user's limb of claim 13, wherein the rehabilitation board comprises four peg openings configured proximal to each of said corners.

15. The method of rehabilitating a user's limb of claim 13, wherein the resistance band is inserted through the peg opening from the bottom surface and wherein the fixed end is retained proximal to the bottom surface of the rehabilitation board.

16. The method of rehabilitating a user's limb of claim 13, wherein the user's limb is a leg having a knee, ankle and a foot, and the extended end of the resistance band is coupled around a user's ankle; and wherein the user slides said foot along the low friction surface of the rehabilitation board from a first position proximal to the first end along the length of the rehabilitation board to a second position that is more proximal to the second end than said first position, thereby extending the knee to rehabilitate the user's knee.

17. The method of rehabilitating a user's limb of claim 13, wherein the fixed end of the resistance band comprises a tapered plug having an enlarged plug dimension at a plug-end that tapers to a smaller dimension at a band-end of the tapered plug; and wherein the peg opening is a band plug retainer comprising a tapered aperture through the thickness of the rehabilitation board having a larger bottom surface opening along the bottom surface of the rehabilitation board that reduces in dimension as the tapered aperture extends through thickness of the rehabilitation board to a smaller working surface opening; and whereby the step of attaching the fixed end of said resistance band to the peg opening comprises inserting the band-end of the tapered plug into the peg opening to attach the fixed end of said resistance band to said peg opening.

* * * * *